US007303235B1

(12) United States Patent
Fongers

(10) Patent No.: US 7,303,235 B1
(45) Date of Patent: Dec. 4, 2007

(54) CHAIR FOR VENUES WITH TIERED SEATING

(75) Inventor: Kenneth L. Fongers, Lowell, MI (US)

(73) Assignee: Preferred Engineering, Lowell, MI (US)

( * ) Notice: Subject to any disclaimer, the term of this patent is extended or adjusted under 35 U.S.C. 154(b) by 0 days.

(21) Appl. No.: 10/905,786

(22) Filed: Jan. 20, 2005

Related U.S. Application Data

(60) Provisional application No. 60/481,927, filed on Jan. 20, 2004.

(51) Int. Cl.
*A47C 1/12* (2006.01)

(52) U.S. Cl. ..... 297/337; 297/217.7; 297/332; 297/352; 52/8; 52/9

(58) Field of Classification Search ..... 297/217.7, 297/15, 331, 335, 332, 333, 337, 352; 52/8, 52/9, 10
See application file for complete search history.

(56) References Cited

U.S. PATENT DOCUMENTS

| | | | | | |
|---|---|---|---|---|---|
| 1,149,541 | A | | 8/1915 | Rees | |
| 1,428,018 | A | * | 9/1922 | Erickson | 297/332 |
| 1,680,469 | A | | 8/1928 | Morgan | |
| 2,132,331 | A | | 10/1938 | Wanamaker | |
| 2,319,109 | A | | 5/1943 | Bulloch | |
| 2,471,030 | A | | 5/1949 | Foulke | |
| 2,530,625 | A | * | 11/1950 | Nordmark | 297/324 |
| 2,558,315 | A | * | 6/1951 | Pavey et al. | 297/352 |
| 2,706,516 | A | | 4/1955 | Nordmark | |
| 2,807,315 | A | | 9/1957 | Manne | |
| 3,041,107 | A | | 6/1962 | Schaefer | |
| 3,066,980 | A | * | 12/1962 | Clute | 297/252 |
| 3,077,364 | A | * | 2/1963 | Eppink | 297/248 |
| 3,172,713 | A | | 3/1965 | Rupert | |
| 3,565,384 | A | | 2/1971 | Lockwood | |
| 3,589,762 | A | * | 6/1971 | Henrikson | 297/324 |
| 4,211,450 | A | * | 7/1980 | Sutter | 297/232 |
| 4,569,162 | A | * | 2/1986 | Suzuki | 52/9 |
| 4,702,043 | A | * | 10/1987 | Suzuki | 52/9 |
| 4,865,237 | A | | 9/1989 | Allen | |
| D307,852 | S | | 5/1990 | Clark | |
| D328,223 | S | | 7/1992 | Clark | |
| 5,320,319 | A | | 6/1994 | Winger et al. | |
| 5,653,502 | A | * | 8/1997 | Kimura et al. | 297/217.7 |
| 5,685,608 | A | * | 11/1997 | Yamazaki | 297/335 |
| 5,819,475 | A | * | 10/1998 | Momose | 52/10 |
| 5,918,937 | A | * | 7/1999 | Moffa et al. | 297/324 |
| 6,244,657 | B1 | * | 6/2001 | Momose | 297/217.7 |
| 6,293,621 | B1 | * | 9/2001 | Marsh et al. | 297/335 |

* cited by examiner

*Primary Examiner*—Laurie K. Cranmer
(74) *Attorney, Agent, or Firm*—McGarry Bair PC

(57) ABSTRACT

A chair that can be mounted to a bleacher comprises a dual-pivot structure to enable movement of a seat between an up position, wherein the seat compactly fits within the bleacher envelope, and a down position, wherein the seat is substantially aligned with the bleacher and located at a suitable seating height. The chair includes single-piece, injection molded bleacher bases, which are composed of a "no-break", fade-resistant plastic and include strategically positioned strengthening ribs. Additional embodiments of the chair comprise a clip-on bleacher base for removably mounting the chair to the bleacher and riser bases and floor bases that can be affixed to a riser portion and a floor portion, respectively, of a step structure.

19 Claims, 24 Drawing Sheets

CHAIR FOR VENUES WITH TIERED SEATING

CROSS-REFERENCE TO RELATED APPLICATION

This application claims the benefit of U.S. patent application No. 60/481,927, filed Jan. 20, 2004.

FIELD OF THE INVENTION

The invention generally relates to a chair. More particularly, the invention relates to a chair adapted for use in a venue, preferably a venue having tiered seating.

DESCRIPTION OF THE RELATED ART

Venues for sporting events, concerts, theater shows, and the like typically comprise tiered seating to accommodate a large number of spectators. Because each row is elevated relative to the preceding row, each audience member has a substantially unobstructed view of the field, playing court, performance stage, etc. In general, tiered seating arrangements involve a step structure, wherein each step mounts a seating surface and defines an aisle, or passageway, between the rows of seating surfaces. The seating surface can be a bleacher, which is a flat metal, plastic, or wood board parallel to the step, a permanent chair, or a folding chair, wherein the seat is movable between an up position when the seat is not in use and a down position when a person is in the seat.

Bleachers are commonly found in older or smaller venues because they are inexpensive and can accommodate several spectators. Because there are no defined boundaries between seats, more people can squeeze onto a given length of bleacher as compared to the number of chairs that can fit within the same length. However, bleachers tend to be very uncomfortable and, as a result, are often undesirable seats. For example, the rigid, flat board can lead to a sore posterior, and the absence of a seat back contributes to back pain and poor posture. Oftentimes, bleacher seats are sold at lower prices because they are considered substandard. A logical course of action for venues with unwanted bleacher seats is to mount chairs onto the bleachers or to replace the bleachers with chairs. Unfortunately, in some bleacher seat venues, the steps are positioned so close to each other such that a chair, either mounted to the bleacher or in place of the bleacher, in an up position extends too far into the aisle and prevents foot traffic therethrough. Further, the rear edge of the seat of a chair mounted onto a bleacher has to be able to clear the bleacher as it pivots between the up and down positions. As a result, the seat must be mounted a certain distance above the bleacher and, therefore, the step. The distance between the seat and the step is much higher than typical seat heights and can render the chair uncomfortable, especially if a person's legs are not long enough to touch the step.

Chairs are the preferred seating surface and are considered a premium seat that can command a higher ticket price. Not only do chairs have contoured seats and supportive seat backs, but they also comprise armrests and provide a wider seating area. Compared to permanent chairs, folding chairs enable the rows of seats to be positioned closer to each other because people can move within the aisles when the seat is in the up position. If the seats are permanently in the down position, the depth of each step has to be large enough to fit both the seat in the down position and the aisle. Additionally, the chairs need to be strong and sufficiently flexible in order to adequately support all body types, including overweight individuals. Further, because some venues are outside or have open roofs such that the chairs are exposed to the outdoor environment, the chairs must be resistant to environmental degradation. Polymeric materials such as blow-molded polyethylene have been used in the manufacture of chairs, but these materials have a tendency to fade with time and sunlight exposure.

SUMMARY OF THE INVENTION

A bleacher mount chair according to the invention comprises a chair having a seat back and a seat moveable between up and down positions, bleacher bases for mounting the chair to a bleacher, and a pivot assembly for coupling the seat to the bleacher bases and for moving the seat between the up and down positions. The pivot assembly includes a dual-pivot structure, wherein a second pivot axis pivots relative to a first pivot axis, that enables the seat to fit into a compact configuration within the bleacher envelope when in the up position and to substantially align with the bleacher at a suitable seating height when in the down position.

The bleacher bases are single-piece, injection molded components having strategically shaped and positioned strengthening ribs and depressions. Each bleacher mount is composed of a "no-break" plastic that resists fading when exposed to sunlight. Further, the bleacher bases can be quickly and securely mounted to the bleacher and are designed to support the mass of overweight and obese individuals.

A clip-on bleacher mount chair according to the invention comprises a seat back mounted to a seat back support and a seat fixed to a clip-on bleacher base that slidingly receives the seat back support and is removably coupled to a bleacher. The clip-on bleacher mount chair is moveable between folded and unfolded conditions. In either condition, the clip-on bleacher mount chair extends only slightly beyond the bleacher envelope. Because the clip-on bleacher mount chair is removable from the bleacher, it can be affixed thereto without physically altering the bleacher and without the use of external tools and can be utilized on a transient basis.

A riser mount chair according to the invention comprises riser bases having a curved lower mounting portion that can be secured to a riser portion of the step structure. Similar to the bleacher bases, the riser bases are single-piece, injection molded components having strategically shaped and positioned strengthening ribs and depressions. Each riser base is composed of a "no-break" plastic that resists fading when exposed to sunlight. The riser mount chair preferably comprises a single-pivot structure. Advantageously, the riser mount chair enables efficient and quick cleaning and sweeping of the step structure.

A floor mount chair according to the invention comprises floor bases that can be secured to a floor portion of the step structure. The floor bases are substantially identical to the riser bases, except that the lower mounting portion extends vertically down rather than curving rearward.

In one aspect, the invention relates to a chair for use in a mass seating venue comprising: at least one base having an upper mounting portion and a lower mounting portion; a seat back mounted to the upper mounting portion of the base; a seat support pivotally mounted to the base for movement between a first lowered position and a first raised position about a first pivot axis; and a seat pivotally mounted to the seat support for movement between a second lowered position and a second raised position about a second pivot axis different than the first pivot axis.

In another aspect, the invention relates to a chair for use in a mass seating venue comprising: at least one base having an upper mounting portion and a lower mounting portion; a seat back mounted to the upper mounting portion of the base; a seat moveable relative to the base for movement between a raised storage position and a lowered use position, wherein in the lowered use position the seat is positioned to be sat upon by a user; and means for both pivoting and laterally shifting the seat relative to the base as the seat moves between the raised storage and lowered use positions.

In a further aspect, the invention relates to a chair for use in a mass seating venue comprising: at least one base having an upper mounting portion and a lower mounting portion; a seat back mounted to the upper mounting portion of the base; and a seat mounted to the base; wherein the lower mounting portion of the base comprises a channel-shaped bracket sized to receive a bleacher; whereby the chair can be fastened to a bleacher in a stable manner by engagement of the lower mounting portion of the base with a bleacher.

In an additional aspect, the invention relates to a chair for use in a mass seating venue comprising: at least one base having an upper mounting portion and a lower mounting portion; a seat back mounted to the upper mounting portion of the base; and a seat mounted to the base; wherein the lower mounting portion of the base comprises a reversely-curved portion with a mounting bracket at a terminal end thereof, wherein the mounting bracket is configured in a generally vertical orientation by virtue of the reverse curve in the lower mounting portion of the base; whereby the chair can be fastened to a generally vertical riser portion of a tiered seating arrangement in a stable manner by engagement of the generally vertical mounting bracket with the generally vertical riser.

Various embodiments of the invention are also contemplated.

The second pivot axis can move with respect to the first pivot axis when the seat support is moved relative to the base. The seat support can comprise an arm connecting the first pivot axis with the second pivot axis. The seat support can be biased into the first raised position by a first spring acting between the seat support and the base. The seat can be biased into the second raised position by a second spring acting between the seat and the seat support.

The pivotal movement between the seat and the seat support can comprise a hinge assembly, wherein the hinge assembly can comprise a first mounting bracket mounted to the seat and a second mounting bracket mounted to the seat support, and wherein the first mounting bracket can be supported for pivotal movement with respect to the second mounting bracket by a bearing. The second spring can comprise a torsion spring acting between the first and second mounting brackets around the bearing.

One of the base and the seat support can comprise an arcuate track and the other of the base and the seat support can comprise a follower pin in register with the track. The track thereby can provide a limited range of movement for the seat support relative to the base by virtue of the location of the follower pin within the track.

The second pivot axis can be offset forwardly with respect to the first pivot axis. The second pivot axis can be offset upwardly with respect to the first pivot axis. The second pivot axis can be offset diagonally with respect to the first pivot axis.

The lower mounting portion of the base can comprise a channel-shaped bracket sized to receive a bleacher. The lower mounting portion of the base can comprise a reversely-curved portion with a mounting bracket at a terminal end thereof, wherein the mounting bracket is configured in a generally vertical orientation by virtue of the reverse curve in the lower mounting portion of the base.

The seat support can comprise an arm connecting the first pivot axis with the second pivot axis. The seat support can be biased into the first raised position by a first spring acting between the seat support and the base.

The channel-shaped bracket of the base can open downwardly to receive the bleacher. The channel-shaped bracket can further comprise at least one mounting aperture so that the lower mounting portion of the base can be mounted to the bleacher by a fastener passing through the at least one mounting aperture in the channel-shaped bracket. The channel-shaped bracket of the base can open laterally to receive the bleacher. The channel-shaped bracket can be firmly mounted to the bleacher without the use of tools. The channel-shaped bracket can comprise a clamp formed by a pair of arms, and the arms clamp on a pair of opposed sides of the bleacher.

At least one of the seat back and the seat can be pivotally mounted to the base. The seat can be pivotally mounted to the base for movement between a raised storage position and a lowered use position, wherein in the lowered use position the seat is positioned to be sat upon by a user. The seat back can be pivotally mounted to the base for movement between a lowered storage position and a raised use position, wherein in the raised use position the seat back is positioned to be rested against by a user.

The upper mounting portion of the base can comprise at least one sleeve, and the seat back can further comprise at least one rod hinged in at least one portion, wherein the at least one hinged rod can be received within a corresponding one of the at least one sleeve on the base. The at least one hinged rod is extended beneath the bleacher and pivoted underneath the bleacher when the seat back is positioned in the raised use position.

BRIEF DESCRIPTION OF THE DRAWINGS

FIGS. 11A-14A are schematic views corresponding to FIGS. 11-14 showing the relative positions of a seat back, the seat, a first pivot axis, and a second pivot axis.

DESCRIPTION OF THE INVENTION

The invention addresses the deficiencies of prior art seating surfaces by providing a unique folding chair assembly having various embodiments for retrofitting a venue having tiered bleacher seating, for replacement of bleacher seats or existing chairs, or for installation into a new venue. The retrofit embodiments comprise a unique dual-pivot structure that enables the folding chair assembly to fit onto the existing bleachers without blocking the aisle when the seat is in a raised, storage position (an up position). When the seat is moved to a lowered, use position (a down position), the dual-pivot structure adjusts such that the seat is located substantially adjacent the bleacher and is at a comfortable height relative to the ground. Several of the embodiments comprise structurally stabile and sufficiently flexible single-piece bases made of no-break polymeric materials with superior environmental resistance.

Figure 1:
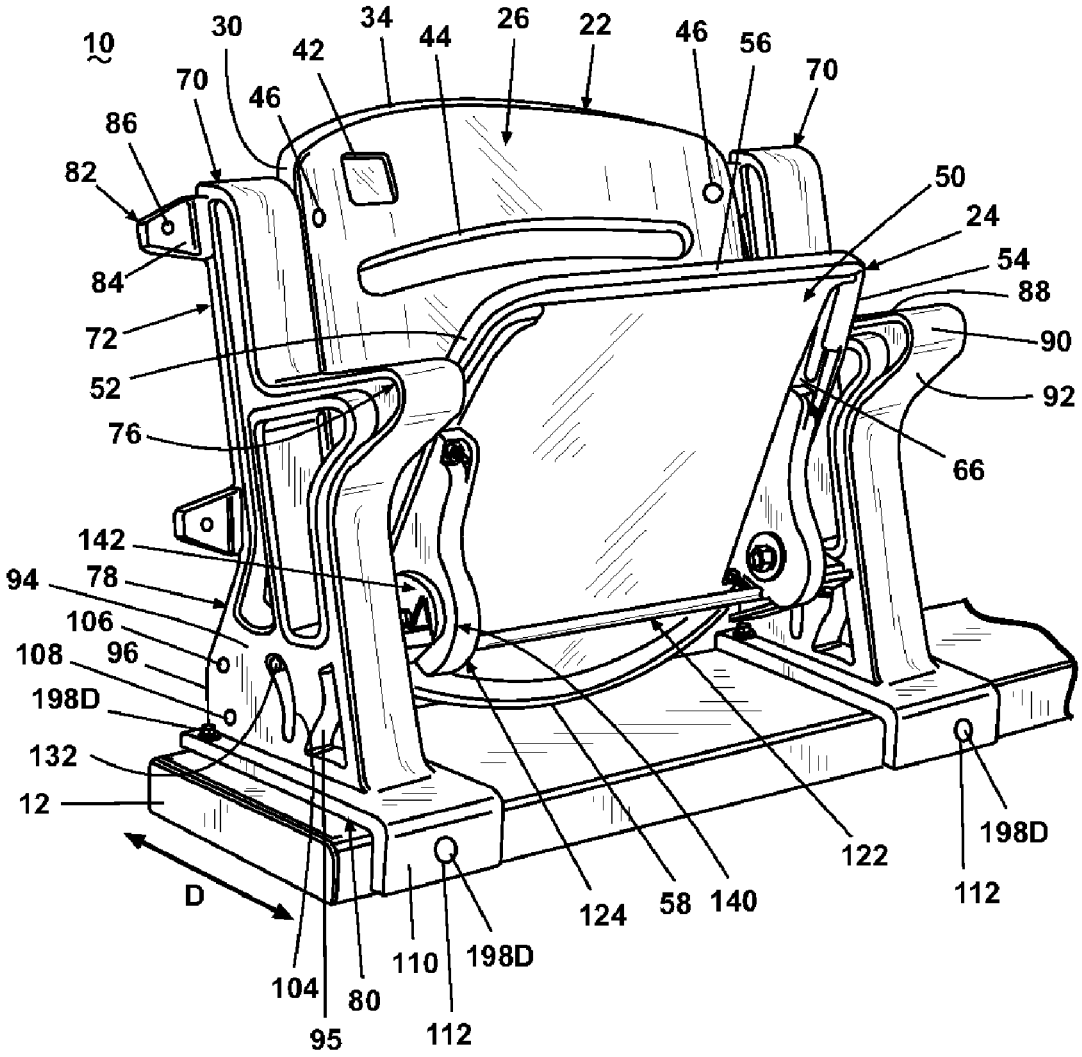
FIG. 1 is perspective view of a bleacher mount chair according to the invention, wherein a seat of the bleacher mount chair is in an up position.
Figure 2:
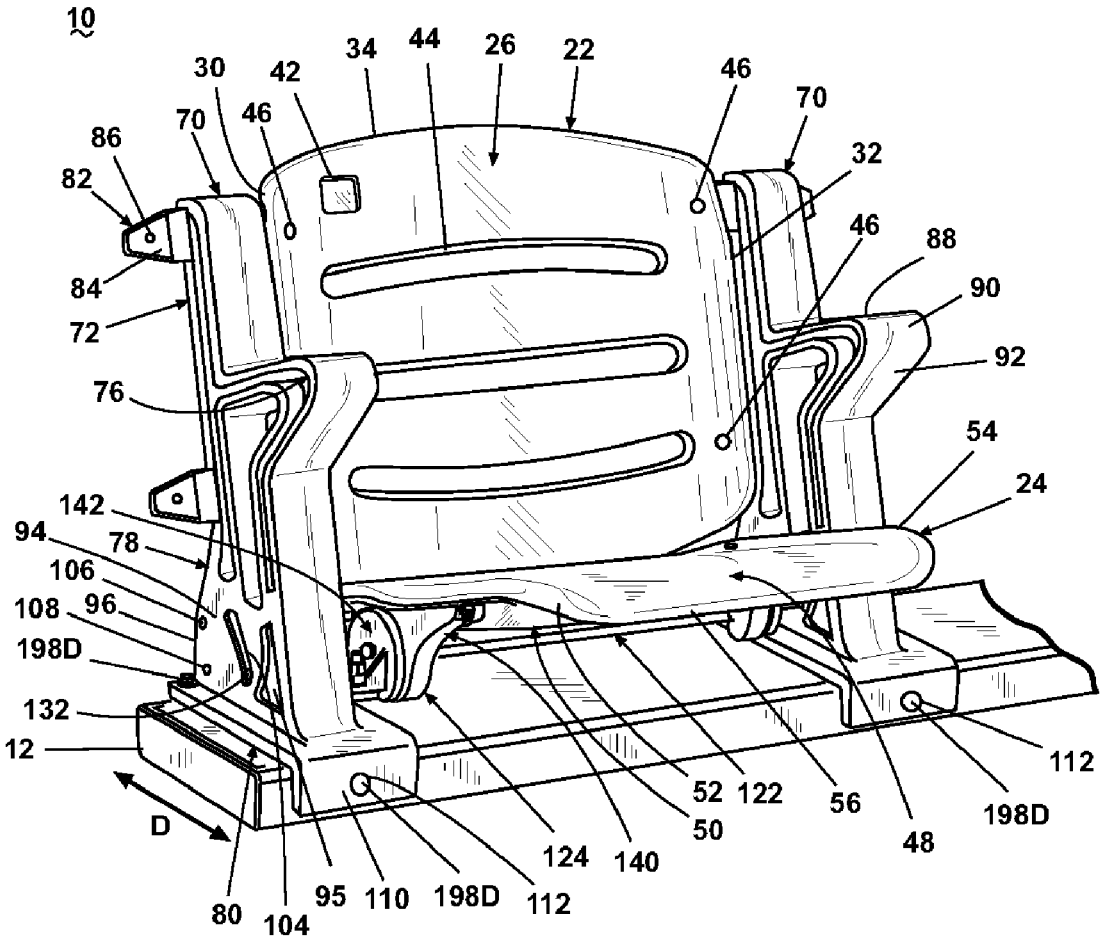
FIG. 2 is a perspective view of the bleacher mount chair from FIG. 1, wherein the seat is in a down position.
Figure 3:
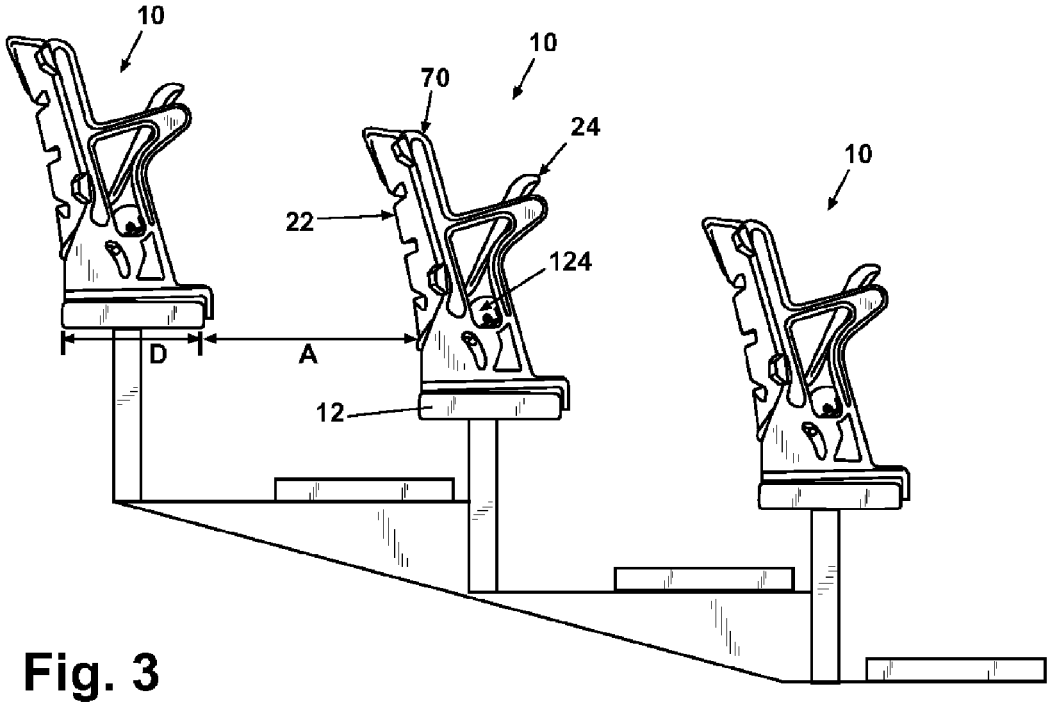
FIG. 3 is a side view of several of several bleacher mount chairs from FIG. 1 mounted to existing bleachers to form rows of spaced folding chairs with aisles therebetween, wherein the seats are in the up position and do not block the aisles.
Figure 4:
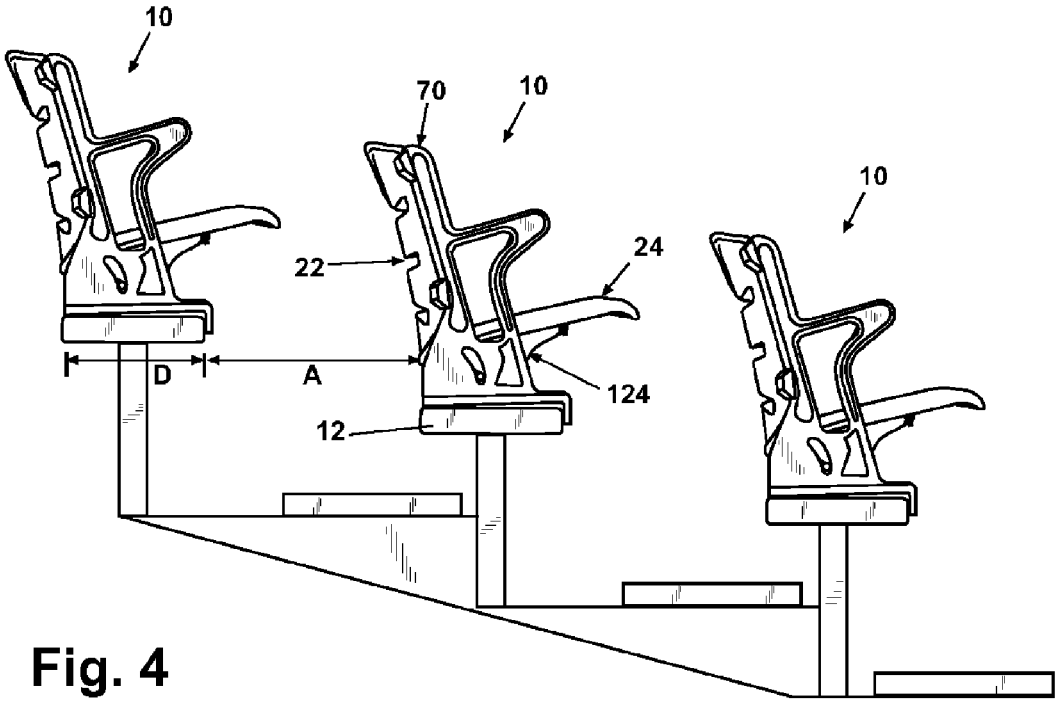
FIG. 4 is identical to FIG. 3 except that the seats are in the down position.

Referring now to the figures, and in particular to FIGS. 1-4, a bleacher mount chair 10 according to the invention comprises a folding chair with a seat back 22 and a seat 24, a pair of bleacher bases 70 that support the chair and are adapted for fixation to a bleacher 12, and a pivot assembly 120 coupled to the chair 10 and to the bleacher bases 70 for moving the seat 24 between an up position, as shown in FIGS. 1 and 3, and a down position, as illustrated in FIGS. 2 and 4. When the seat 24 is in the up position, it fits within the envelope, or the depth D, of the bleacher 12 so that the bleacher mount chair 10 does not block the aisle A. The seat 24 in the down position is situated at a comfortable seating height fairly close to the bleacher 12.

Figure 5:
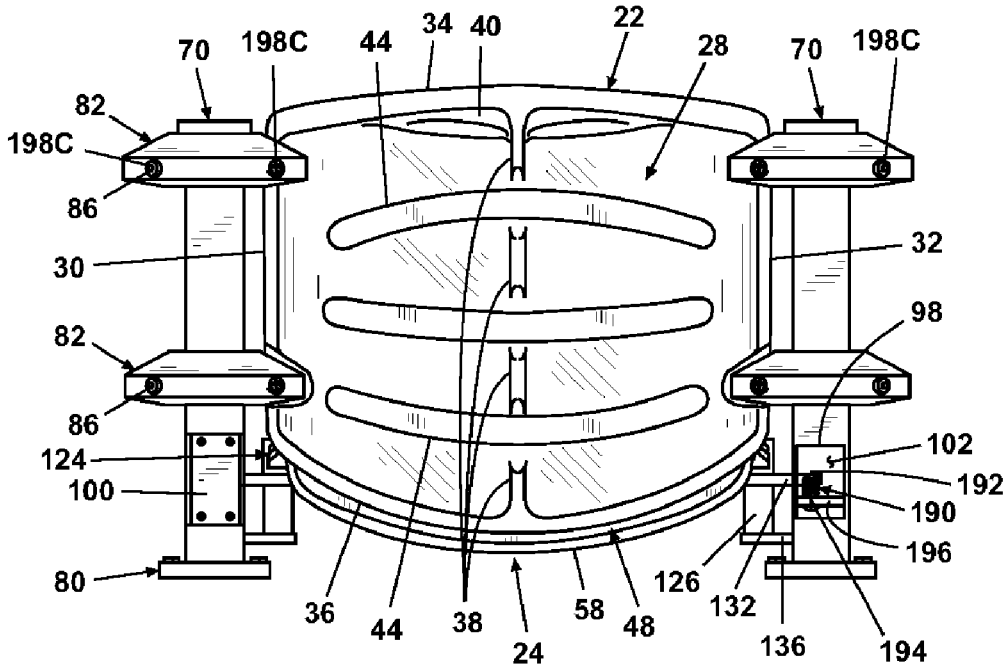
FIG. 5 is a rear view of the bleacher mount chair from FIG. 1 with a cover plate removed to show the position of an extension spring when the seat is in the up position.
Figure 6:
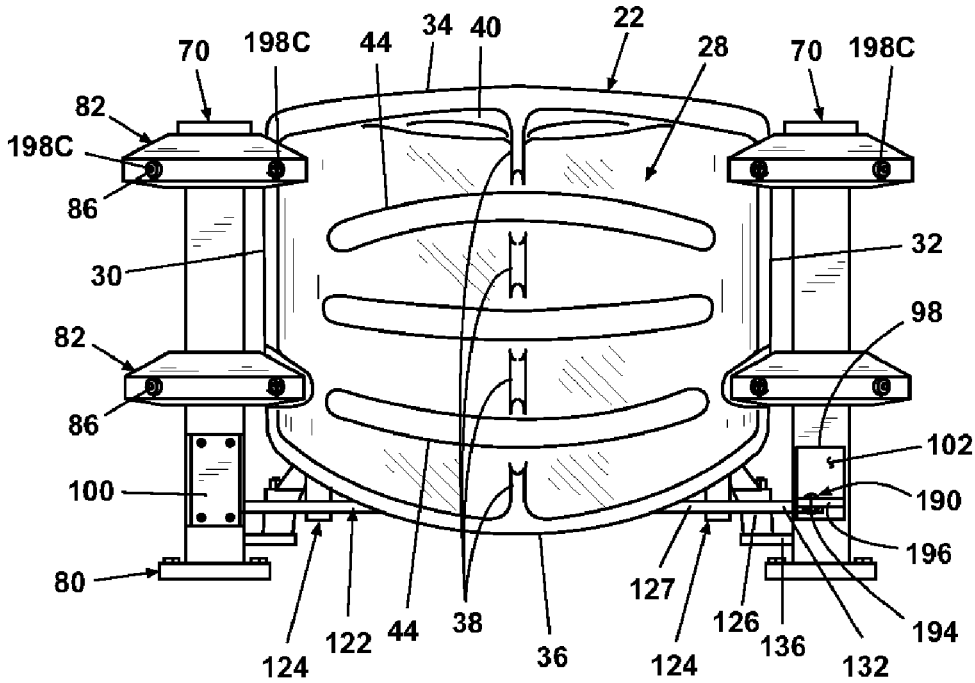
FIG. 6 is a rear view of the bleacher mount chair from FIG. 2 with the cover plate removed to show the position of the extension spring with the seat is in the down position.
Figure 7:
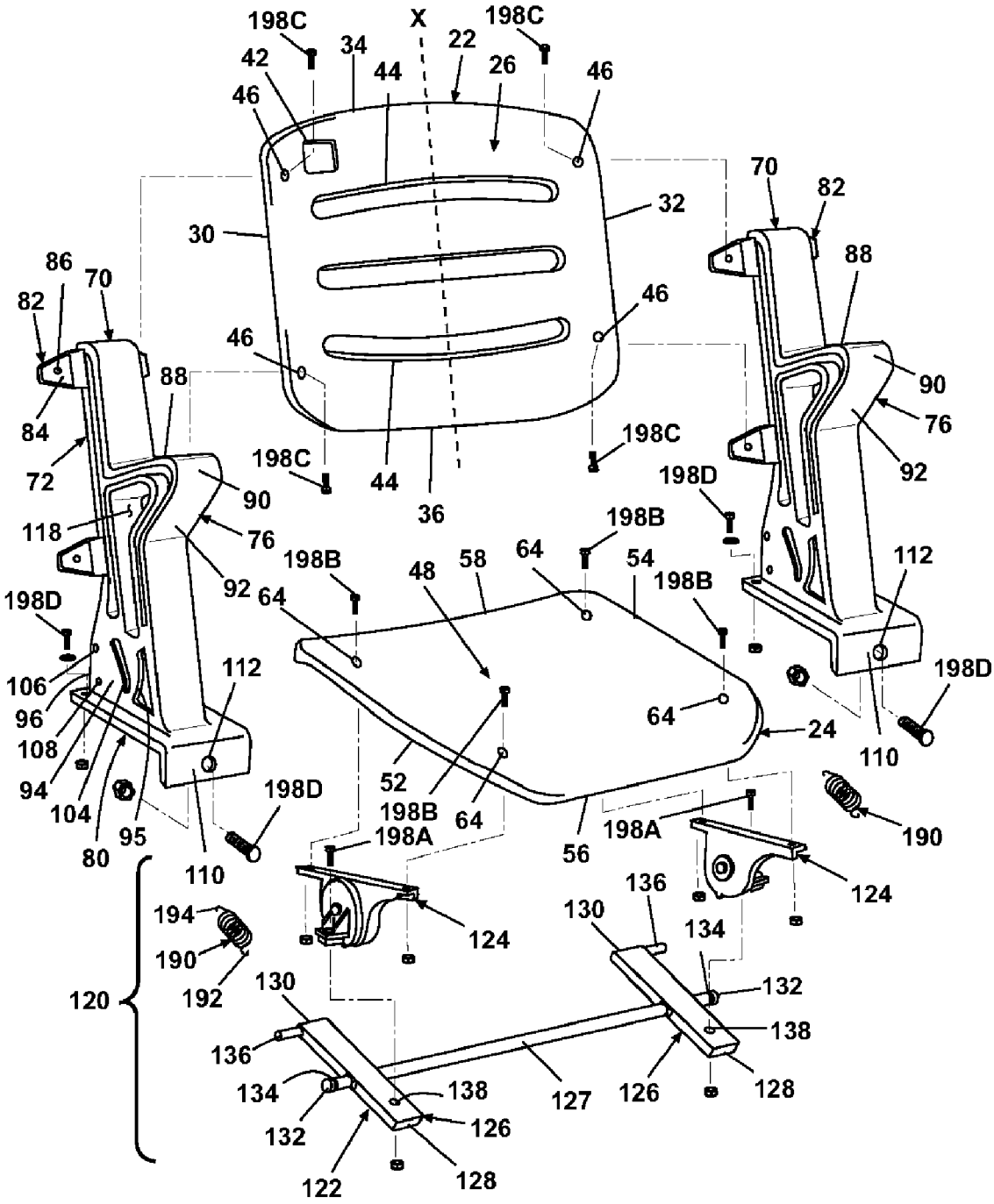
FIG. 7 is an exploded view of the bleacher mount chair from FIG. 1.

The seat back 22, which is best viewed in FIGS. 5-7, comprises front and rear surfaces 26, 28 joined along a perimeter defined by spaced, substantially straight side edges 30, 32 and rounded top and bottom edges 34, 36. The front and rear surfaces 26, 28 are curved about a longitudinal axis X to comfortably accommodate a person's back. To provide strength and rigidity, several ribs 38 and depressions 40 are strategically disposed on the rear surface 28 and near the perimeter. The front surface 26, optionally textured for a tactile feel, can include a recess 42 sized to receive a plate exhibiting a seat number, advertisement, or the like. The seat back 22 further comprises elongated, generally horizontal slots 44 and pairs of opposed holes 46 along the side edges 30, 32 to facilitate mounting the seat back 22 to the bleacher bases 70, as will be described hereinafter. The seat back 22 is illustrated by example in the figures as having three slots 44, but it is within the scope of the invention for the seat back 22 to comprise any number of slots 44.

Similar to the seat back 22, the seat 24, as best seen in FIGS. 1 and 7, comprises top and bottom surfaces 48, 50 joined at a perimeter defined by spaced, substantially straight side edges 52, 54 and front and rear edges 56, 58. While the rear edge 58 is rounded like the seat back top edge 34, the front edge 56 is fairly straight. The optionally textured top surface 48 is slightly concave to accommodate a person's posterior and curves downward near the front edge 56 such that it is contoured for a person's legs. The seat 24 further comprises pairs of opposed holes 64 along the side edges 52, 54 and planar regions 66 on the bottom surface 50 to facilitate mounting the seat 24 to the pivot assembly 120, as will be described hereinafter.

Both the seat back 22 and the seat 24 are single-piece components produced using an injection molding process and composed of a "no-break," fade-resistant plastic. Absence of seams or joints in the single-piece seat back 22 and the single-piece seat 24 contributes to the overall strength of the bleacher mount chair 10.

Figure 8:
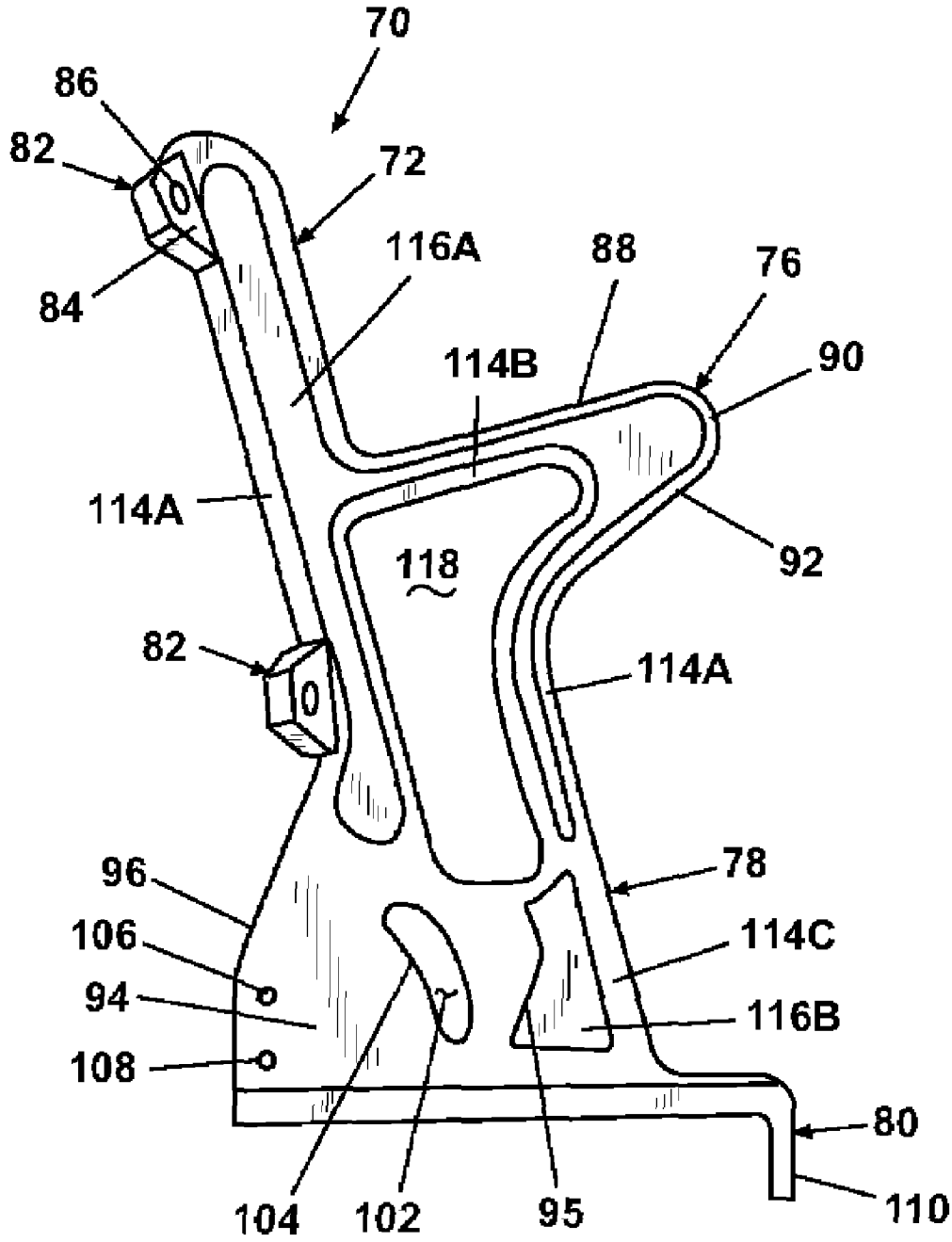
FIG. 8 is a side view of a bleacher base from the bleacher mount chair from FIG. 1.

Referring now to FIGS. 7 and 8, the bleacher base 70 is an irregularly-shaped, single-piece component with an upper mounting portion 72 for mounting the seat back 22, an arm rest 76 that extends forward from the upper mounting portion 72, and a lower mounting portion 78 that houses part of the pivot assembly 120 and terminates in a mounting bracket 80. Vertically spaced tapered mounting arms 82 extend laterally from both sides of the bleacher base 70. Each mounting arm 82 includes a front face 84 angled to complement the curved seat back 22 and a hole 86 extending therethrough. The arm rest 76 comprises an upper planar surface 88 sized to support a person's elbow and forearm and a rounded front edge 90 that merges into a lower planar surface 92 and the lower mounting portion 78. The upper mounting portion 72 and the upper planar surface 88 of the arm rest 76 are substantially orthogonal relative to each other and are slightly rotated such that the upper mounting portion 72 is tilted to the rear. The lower mounting portion 78 comprises spaced side walls 94 joined at their front edges by a front wall 95 and at their rear edges by a rear wall 96 having an access opening 98 covered by an access panel 100. The side walls 94, the front wall 95, and the rear wall 96 define a hollow interior 102 that houses part of the pivot assembly 120. An arcuate track 104 and upper and lower apertures 106 and 108 extend through each side wall 94 near the front and rear edges thereof, respectively. As seen in FIGS. 5 and 6, a rod 196 is situated between the upper apertures 106. The lower mounting portion 78 merges into the mounting bracket 80, which has a width greater than that of the lower mounting portion 78 and a depth substantially equal to that of the bleacher 12. The mounting bracket 80 includes mounting holes 113 and a downward flange 110 with a mounting aperture 112 extending therethrough. The flange 110, together with the rest of the mounting bracket 80, forms a downwardly opening channel sized to receive at least a portion of the bleacher 12 so that the bleacher base 70 can be placed on the bleacher 12 and mounted thereto.

The bleacher base 70 further comprises several strategically positioned reinforcement ribs 114 and depressions 116. For example, a rib 114A forms a perimeter around the upper mounting portion 72 and the arm rest 76, and another rib 114B is inset from the perimeter rib 114A and defines an opening 118 in the center of the bleacher base 70. The region between the ribs 114A and 114B forms a depression 116A. Another depression 116B is formed between the front wall 95 in the lower mounting portion 78 and a rib 114C that is integral with the perimeter rib 114A. The ribs 114 and depressions 116 significantly contribute to the strength of the bleacher base 70. Similar to the seat back 22 and the seat 24, the bleacher bases 70 are single-piece components produced using an injection molding process and composed of a "no-break," fade-resistant plastic, preferably polypropylene.

The pivot assembly 120 for partially supporting the seat 24 and for moving the seat 24 between the up and down positions comprises a seat support in the form of a carriage 122 pivotally mounted to the bleacher bases 70 and a pair of torsion spring hinge assemblies 124 that couple the seat 24 to the carriage 122. The carriage 122, which is best viewed in FIG. 7, includes spaced arms 126 joined by a carriage rod 127. Each arm 126 has a front edge 128 and a rear edge 130, and the carriage rod 127 is fixed to the arms 126 approximately midway between the front and rear edges 128, 130. Outwardly extending follower pins 132 affixed to each arm 126 in linear alignment with the rod 127 are provided with circumferential notches 134 for engaging a first end 192 of an extension spring 190. As illustrated in FIG. 6, a second end 194 of the extension spring 190, when assembled, is secured to the rod 196 in the bleacher base 70. Each arm 126 further comprises pivot bars 136 located near the rear edges 130 and on the same side as the follower pins 132. The pivot bars 136 function as a first pivot axis PA1 when the seat 24 moves between the up and down positions, as will be described in more detail hereinafter. A hole 138 is disposed through each arm 126 near the front edge 128 to facilitate the mounting of the torsion spring hinge assembly 124 to the carriage 122.

Figure 9:
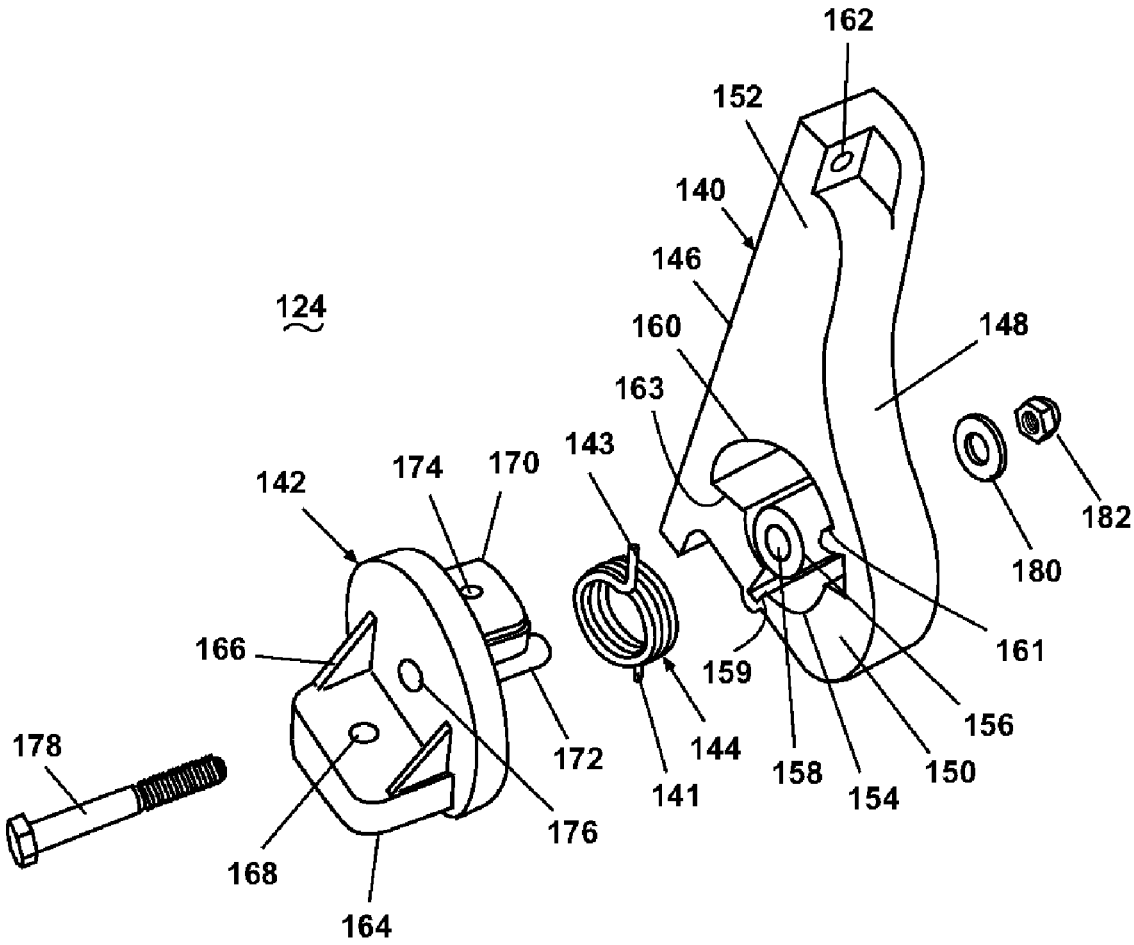
FIG. 9 is an exploded view of a torsion spring hinge assembly from the bleacher mount chair from FIG. 1.

Referring now to FIGS. 7 and 9, each torsion spring hinge assembly 124 comprises a first mounting bracket 140 and a second mounting bracket 142 operably coupled and biased by a torsion spring 144 having a first end 141 and a second end 143. The first mounting bracket 140 has a perimeter defined by a substantially flat surface 146 and curved surface 148 to form somewhat of a tear-shaped body in that it includes a larger, fairly round portion 150 that narrows into a smaller, tapered portion 152. A cavity 154 disposed within the round portion 150 is sized to receive and retain the torsion spring 144, and a bearing 156 having a bore 158 therethrough is located within the cavity 154. The cavity 154 forms a groove 159 for retaining the first end 141 of the torsion spring 144 and an arcuate slot 160 defined between first and second limit stops 161, 163 to accommodate and limit movement of the torsion spring hinge assembly 124. The first mounting bracket 140 further comprises a pair of mounting apertures 162 that pass through the flat surface 146 for mounting the torsion spring hinge assembly 124 to the seat 24.

The second mounting bracket 142 is a generally circular body with a mounting flange 164 having supportive truss-like webs 166 and a mounting aperture 168 for mounting the torsion spring hinge assembly 124 to the carriage 122. A spring flange 170 and a projection 172 sized for receipt within the arcuate slot 160 and the bore 158, respectively, of the bearing 156 extend from the side of the second mounting bracket 142 opposite the mounting flange 164. The spring flange 170 includes a radial aperture 174 therethrough for retaining the second end 143 of the torsion spring 144, and the projection 172 comprises a bore 176 therethrough.

To assemble the torsion spring hinge assembly 124, the torsion spring second end 143 is inserted into the radial aperture 174 of the second mounting bracket 142, and the torsion spring 144 loosely fits over the projection 172. Next, the first and second mounting brackets 140, 142 are oriented such that the torsion spring first end 141 aligns with the groove 159, the projection 172 aligns with the bore 158, and the spring flange 170 aligns with the arcuate slot 160. Once the proper alignment is achieved, the first and second mounting brackets 140, 142 are brought together so that the torsion spring 144 surrounds the bearing 156 and the bore 158 receives the projection 172. The torsion spring 144, the bearing 156, and the projection 172 comprise a common horizontal rotation axis, which functions as a second pivot axis PA2 when the seat 24 moves between the up and down positions, as will be described in more detail hereinafter. The torsion spring hinge assembly 124 is held together by a bolt 178 that is inserted through the bore 176 and is secured in place by a washer 180 and a nut 182. The bolt 178 is coincident with the second pivot axis PA2.

The torsion spring hinge assembly 124 is movable between an initial, up position, as shown in FIGS. 1 and 7, and a final, down position, as seen in FIG. 2. The initial and final positions respectively correspond to the up and down positions of the seat 24. Regardless of the position, the first end 141 of the torsion spring 144 is seated in the groove 159. In the initial position, the spring flange 170 is situated against the first stop 161 of the arcuate slot 160 such that the second end 143 of the torsion spring 144 is approximately diametrically opposite the first end 141. Rotational force applied to the first mounting bracket 140 and against the bias of the torsion spring 144 moves the torsion spring hinge assembly 124 to its final position. Assuming the first mounting bracket 140 rotates relative to the second mounting bracket 142, the arcuate slot 160 rotates relative to the spring flange 170 and the torsion spring second end 143 as the torsion spring first end 141 moves towards the torsion spring second end 143. In the final position, the spring flange 170 abuts the second stop 163, and the torsion spring first and second ends 141, 143 are preferably oriented with an angle therebetween of less than 180 degrees. When the rotational force is released, the torsion spring 144 biases the torsion spring hinge assembly 124 back to its initial position.

An exemplary description of the assembly of the bleacher mount chair 10 follows. It will be apparent to one of ordinary skill that the assembly procedure can proceed in any logical order and is not limited to the sequence presented below. The following description is for illustrative purposes only and is not intended to limit the invention in any manner.

To begin assembly of the bleacher mount chair 10, the carriage 122 is situated between and attached to two bleacher bases 70. The following description details the mounting of the carriage 122 to one of the bleacher bases 70, with the understanding that the other side of the carriage 122 is mounted to the other bleacher base 70 in the same manner.

In particular, the pivot bar 136 and the follower pin 132 are inserted into the lower aperture 108 and the arcuate track 104, respectively, in the bleacher bases 70. The pivot bar 136 and the follower pin 132 extend approximately halfway into the hollow interior 102. The extension spring 190 is coupled to the carriage 122 and the bleacher base 70 by securing the first end 192 onto the notch 134 on the follower pin 132 and coupling the second end 194 to the rod 196 in the bleacher base 70.

Next, the torsion spring hinge assemblies 124 are fixed to the carriage arms 126 with screws 198A or other suitable fasteners through the mounting apertures 162 on the flanges 164 and the holes 138 on the carriage arms 126. The seat 24 is positioned on the torsion spring hinge assemblies 124 such that the flat surfaces 146 of the first mounting brackets 140 abut against the planar regions 66 of the seat bottom surface 50. Screws 198B through the seat holes 64 and the first mounting bracket mounting apertures 162 fasten the seat 24 to the torsion spring hinge assemblies 124. Finally, the seat back 22 is positioned against the front faces 84 of the bleacher mount mounting arms 82 and secured thereto with screws 198*c* through the seat holes 46 and the mounting arm holes 82.

Alternatively, the torsion spring pivot assemblies 124 can be mounted to the seat 24 before they are secured to the carriage 122. Further, the seat back 22 can be fastened to the bleacher bases 70 before the seat 24 is fixed to the pivot assembly 120. As stated above, the bleacher mount chair 10 can be assembled in several manners, and the user can determine the preferred method of assembly.

Figure 10:
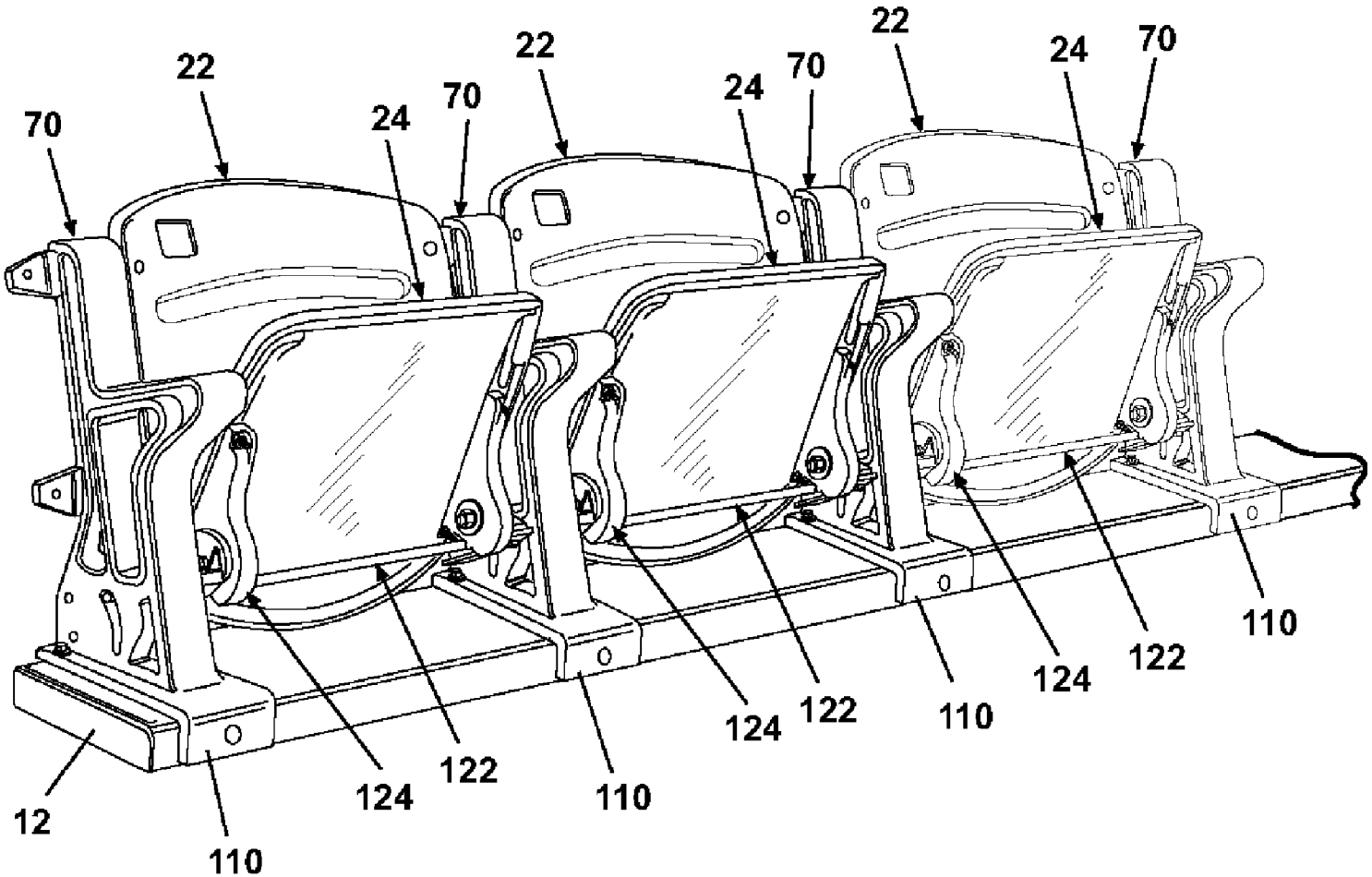
FIG. 10 is a perspective view of a linear arrangement of the bleacher mount chair from FIG. 1.

The above assembly procedure can be repeated to form a linear arrangement, or a row, of interconnected bleacher mount chairs 10, as illustrated in FIG. 10. In this arrangement, adjacent bleacher mount chairs 10 share a common bleacher base 70. Because the pivot bars 136 and the follower pins 132 extend approximately halfway into the hollow interiors 102, sufficient space remains within the hollow interiors 102 for insertion of another carriage 122 into the opposite side of the bleacher base 70. For a clean appearance, the terminal bleacher bases 70 on the first and last bleacher mount chairs 10 in a linear arrangement can optionally lack the unused mounting arms 82.

Once the single bleacher mount chair 10 or linear arrangement of bleacher mount chairs 10 is assembled, it is mounted to the bleacher 12, as illustrated in FIGS. 1-4. The bleacher mount chair 10 is set on the bleacher 12 in the desired location, with the downward flange 110 of the mounting bracket 80 abutting the front edge of the bleacher 12 to ensure proper alignment of the bleacher mount chair 10. The bleacher mount chair 10 is affixed to the bleacher 12 with fasteners 198D through the mounting apertures 112 and 113 in the mounting bracket 80 and through the bleacher 12.

Progressive movement of the seat 24 from the up position to the down position is illustrated in FIGS. 11-14 and shown schematically in FIGS. 11A-14A. The schematic views show the position of the seat 24 relative to the seat back 22 and the relative positions of the first pivot axis PA1, which is defined by the pivot bar 136, the second pivot axis PA2, which is coincident with the bolt 178, and the follower pin 132 onto which the first end 192 of the extension spring 190 is fastened. The distance between the PA1 and the follower pin 132 is fixed, as is the distance between the follower pin 132 and the PA2; therefore, the distance between the PA1 and the PA2 is fixed. During movement of the seat 24, the carriage 122 pivots about the PA1 from a raised position to a lowered position. Because the torsion spring hinge assembly 124 is fixed to the carriage 124, the PA2 also pivots about the PA1. At the same time, the seat 24 pivots about the PA2. The following description elucidates this dual-pivot relationship.

Figure 11A:
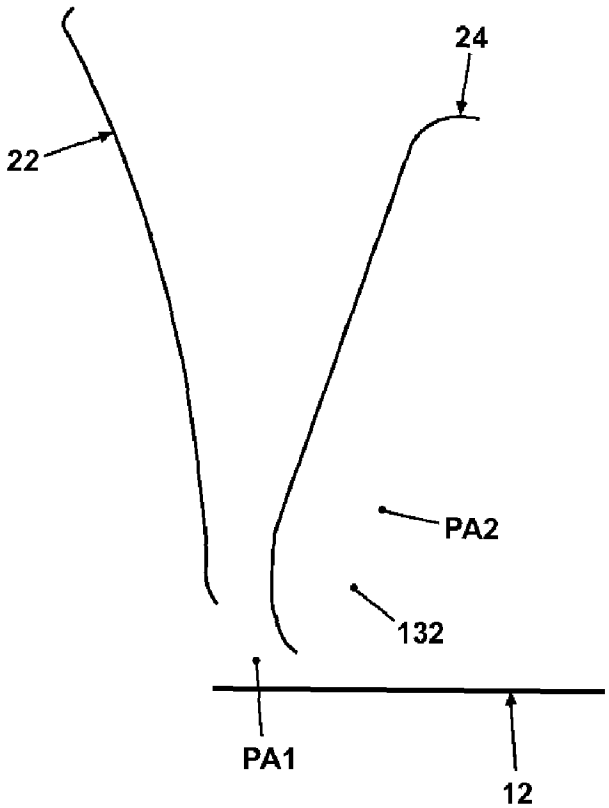
Figure 11:
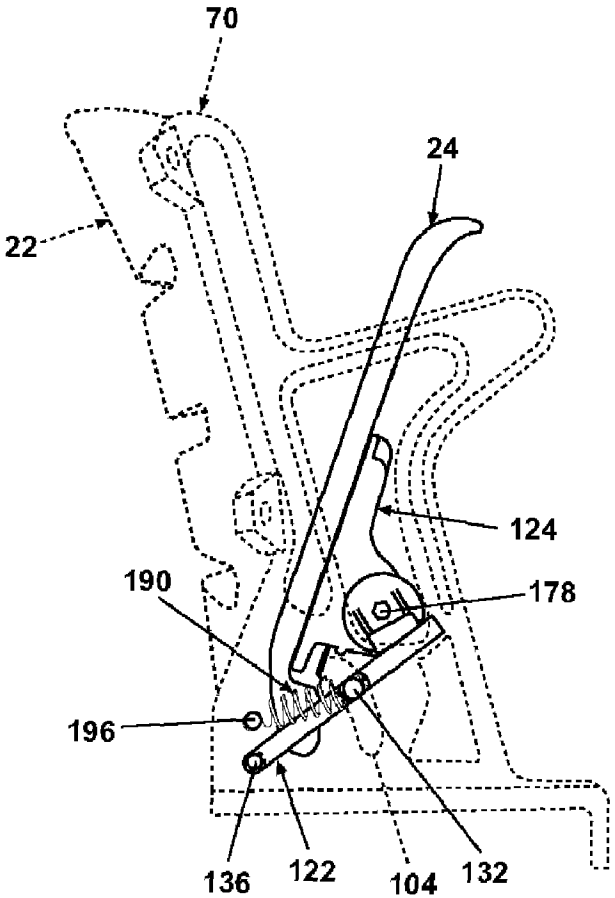
FIGS. 11-14 are side views of the bleacher mount chair from FIG. 1 progressively moving from the up position (FIG. 11) to the down position (FIG. 14).
Figure 12A:
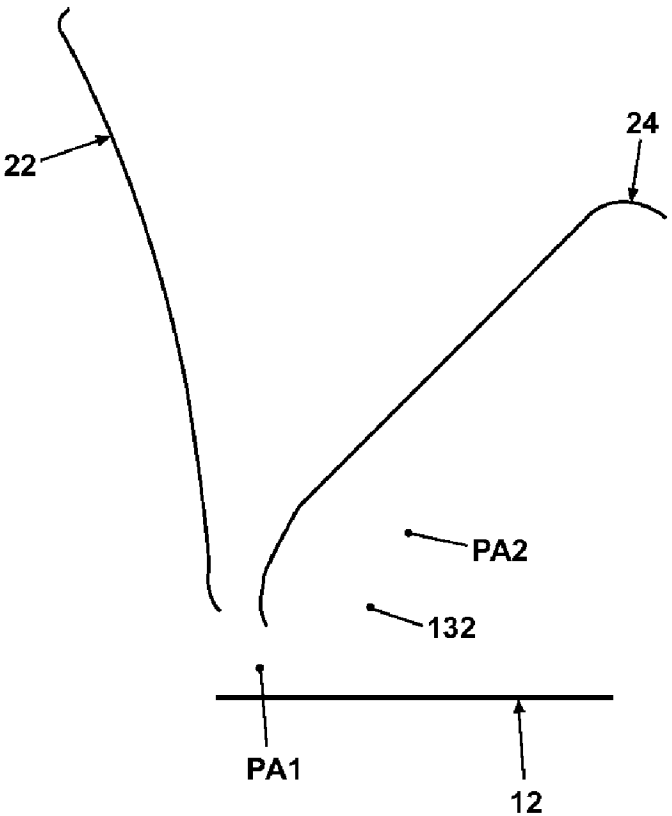
Figure 12:
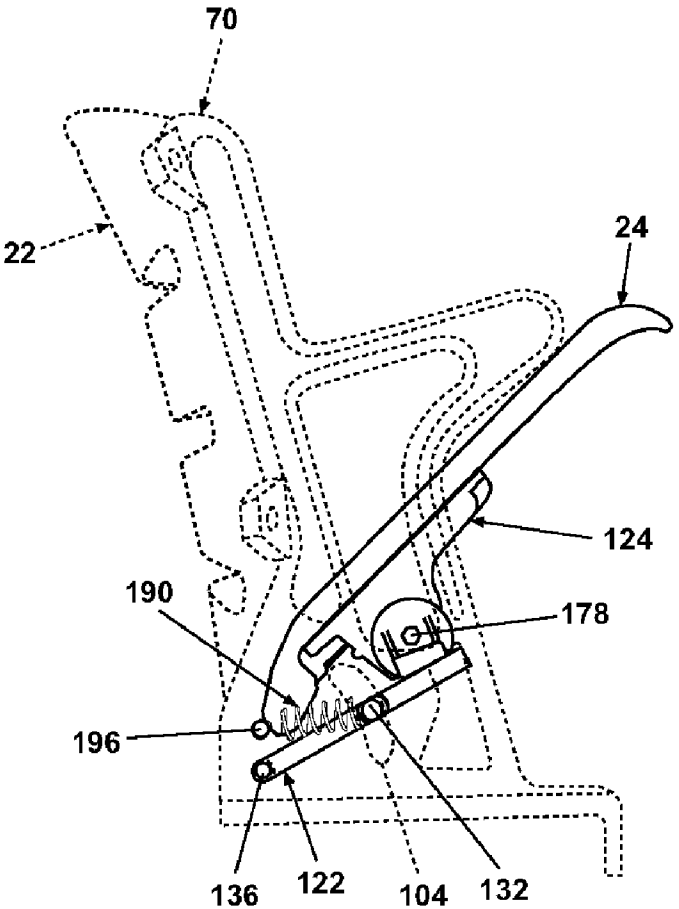
Figure 13A:
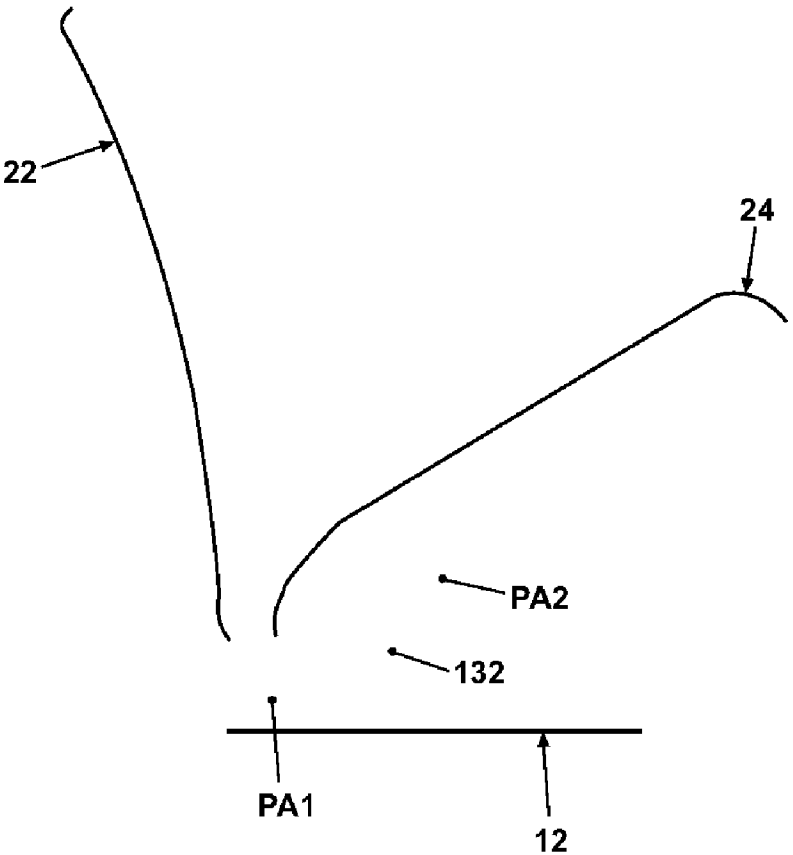
Figure 13:
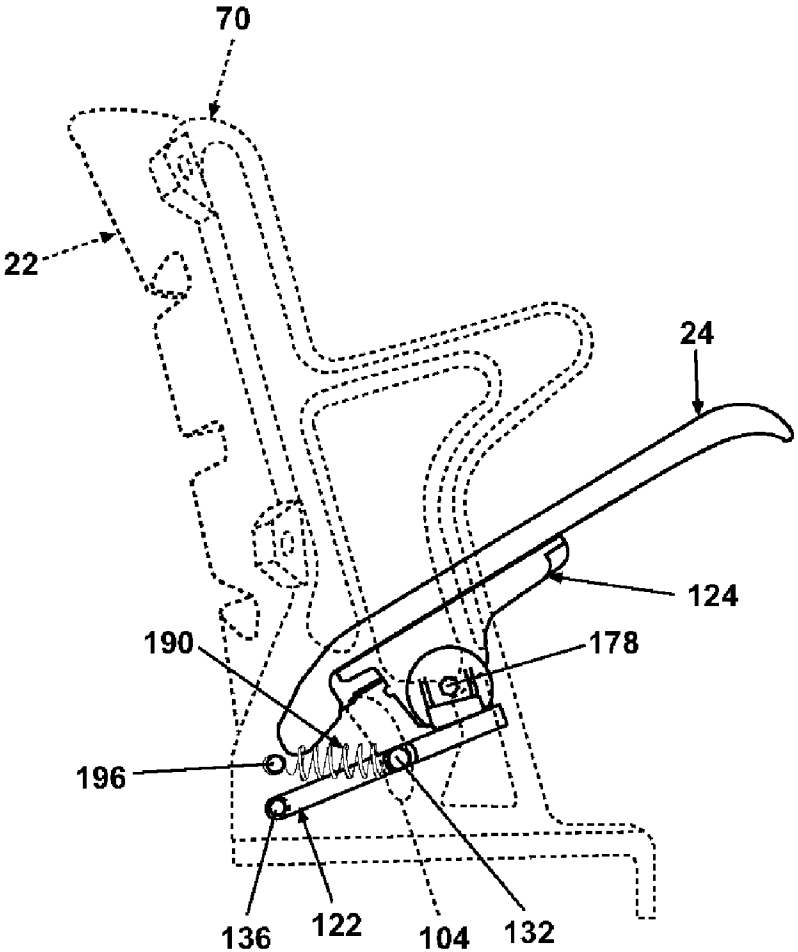

Initially, the extension spring 190 and the torsion spring 144 bias the seat 25 into the up position (FIGS. 11 and 11A). In other words, the extension spring 190 exerts a pulling force on the carriage 122, and the torsion spring biases the torsion spring hinge assembly 124 into its initial position. When the seat 24 is in the up position, the follower pin 132 is located approximately near the top of the arcuate track 104 and slightly above the rod 196, as best viewed in FIG. 3. Further, the front and rear edges 56, 58 of the seat 24 are located near the arm rest 74 and substantially adjacent the bleacher 12, respectively.

Downward force applied to the seat 24 induces simultaneous movement of the seat 24 and the pivot assembly 120. As the seat 24 moves through the positions shown in FIGS. 12 (12A) and 13 (13A), the carriage 122 and, thus, the PA2 rotate about the PA1, and the seat 24 pivots about the PA2. While the carriage 122 rotates, the follower pin 132 travels within the arcuate track 104 against the bias of the extension spring 190, and motion of the PA2 follows that of the follower pin 132. As the PA2 moves along an arcuate path, downward force on the seat 24 compels the torsion spring hinge assembly 124 against the bias of the torsion spring 144 and towards its final position, as described hereinabove. Consequently, the seat 24 rotates about the PA2 in somewhat of a seesaw motion and simultaneously travels in a forward and downward arcuate path.

Figure 14A:
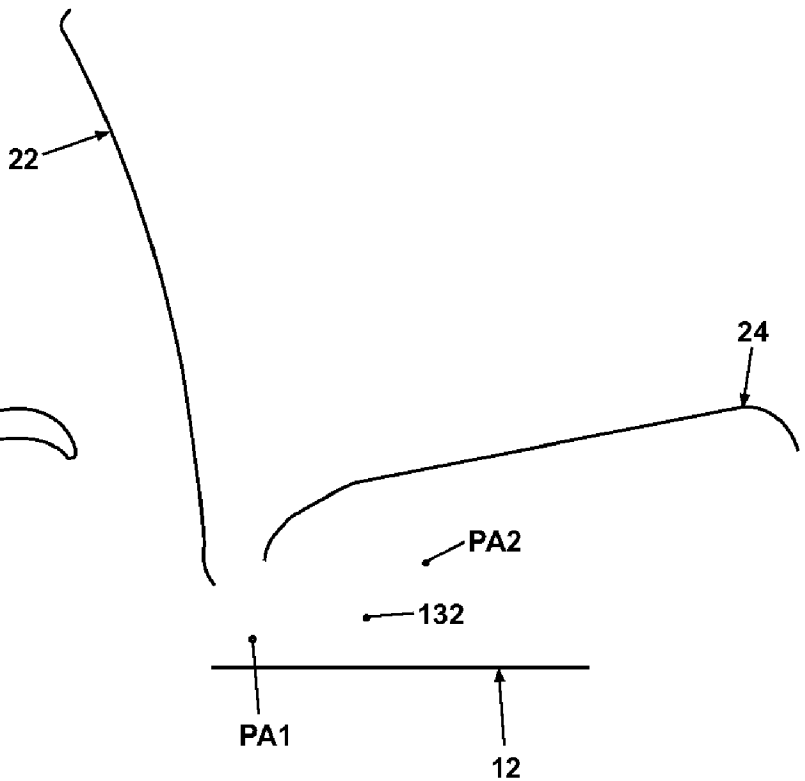
Figure 14:
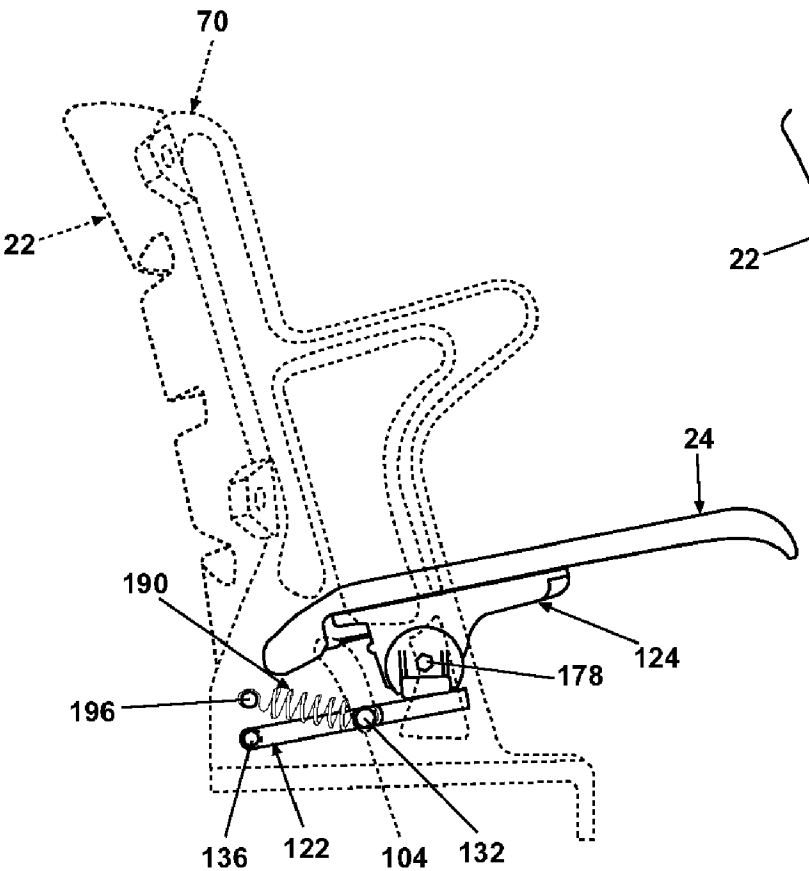

Once the seat 24 reaches the down position illustrated in FIG. 14 (14A), the carriage 122 and the PA2 are fully rotated about the PA1, and the torsion spring hinge assembly 124 achieves its final position. The follower pin 132 is located approximately near the bottom of the arcuate slot 160 and below the rod 196, as been seen in FIG. 4. The seat 24 is oriented at an appropriate seating angle and height. In particular, the front edge 56 projects forward of the lower mounting portion 78, and the rear edge 58 is substantially adjacent the bottom edge 36 of the seat back 22.

When the downward force is removed, the seat 24 returns to the up position. The extension spring 190 retracts and thereby rotates the carriage 122 and the PA2 back to the positions shown in FIG. 11, and the torsion spring 144 biases the torsion spring hinge assembly 124 to its initial position.

Figure 15A:
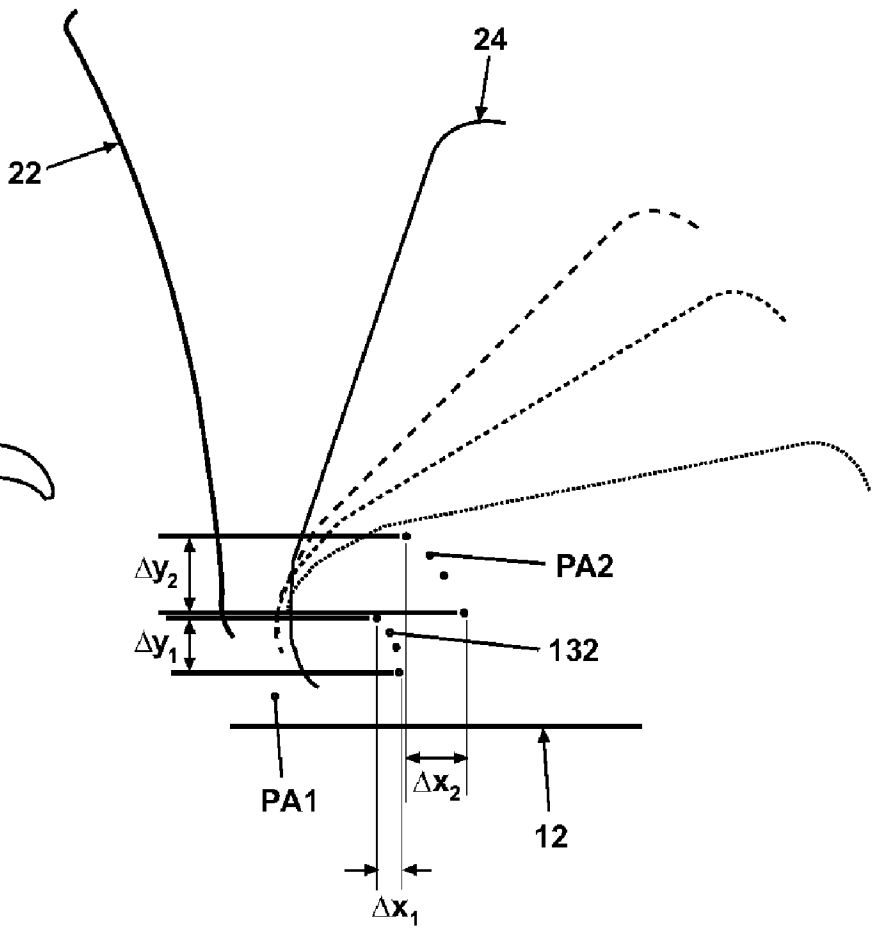
FIG. 15A is a composite of the four schematics of FIGS. 11A-14A, wherein the schematics are superimposed on one another to illustrate the movement of the seat and the second pivot axis as the seat moves from the up position to the down position.
Figure 15:
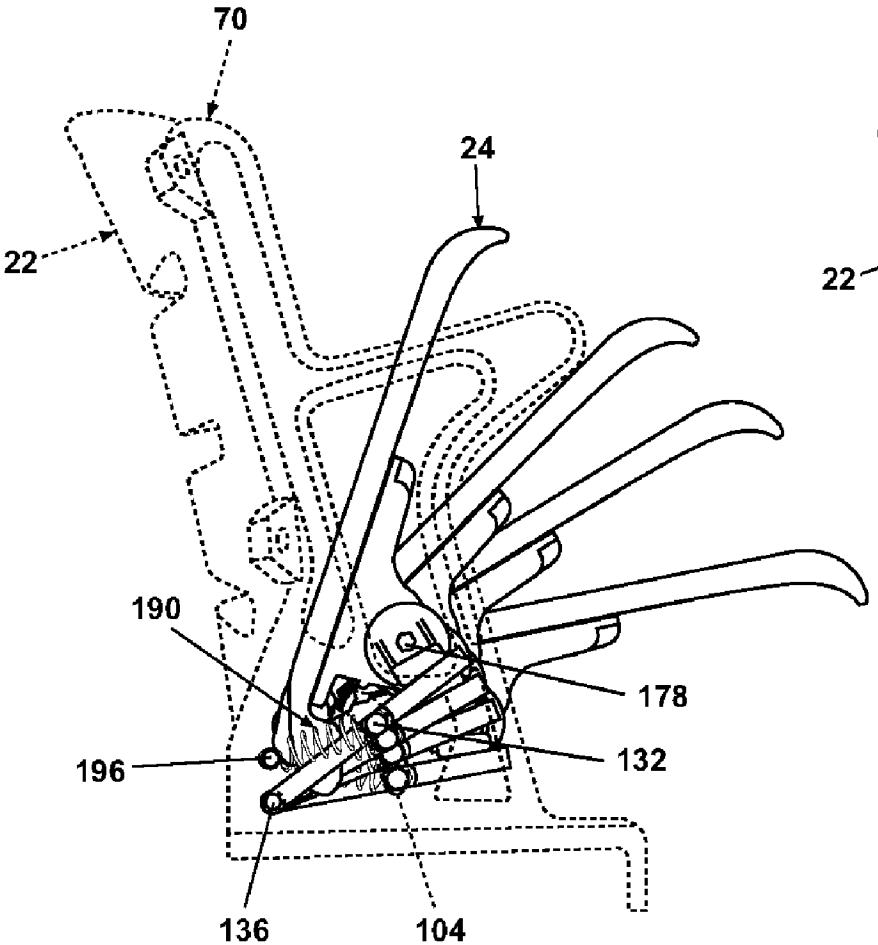
FIG. 15 is a composite of the four side views of FIGS. 11-14.

FIGS. 15 and 15A provide an overall view of the movement of the seat 24 between the up and down positions. The arcuate paths of the follower pin 132 and the PA2 are clearly seen in FIG. 15A. Specifically, the follower pin 132 moves horizontally a distance $\Delta x_1$ and vertically a distance $\Delta y_1$. Similarly, the PA2 is displaced horizontally and vertically by $\Delta x_2$ and $\Delta y_2$, respectively. Because the PA2 is farther away from the common pivot axis, PA1, $\Delta x_2 > \Delta x_1$ and $\Delta y_2 > \Delta y_1$. More importantly, the forward ($\Delta x_2$) and downward ($\Delta y_2$) displacement of the PA2 when the seat 24 moves from the up position to the down position enables the seat 24 to rotate about the PA2 to a suitable seating angle and height without interference from the seat back 22. Since the seat 24 shifts forward as it moves down, the rear edge 58 clears the bottom edge 36 of the seat back 22. If the seat 24 was in the up position and the PA2 was stationary, then the seat back 22 would block the rotation of the seat 24 to the down position. Conversely, rearward ($\Delta x_2$) and upward ($\Delta y_2$) displacement of the PA2 when the seat 24 returns to the up position enables the seat 24 to fold against the seat back 22 in a compact configuration within the bleacher envelope without interference from the bleacher 12. Because the seat 24 shifts upwards as it moves back, the rear edge 58 clears the top surface of the bleacher 12. If the seat 24 was in the down position and the PA2 was stationary, then the bleacher 12 would prevent the seat 24 from rotating to the up position. As a result of the dual-pivot structure wherein the PA2 pivots about the PA1, the seat 24 can move from a position within the bleacher envelope to a position substantially aligned with and adjacent and the bleacher 12. Consequently, the bleacher mount chair 10 can be retrofitted onto existing bleachers 12, even in venues where bleacher rows are quite close to one another and aisles are narrow.

Figure 16:
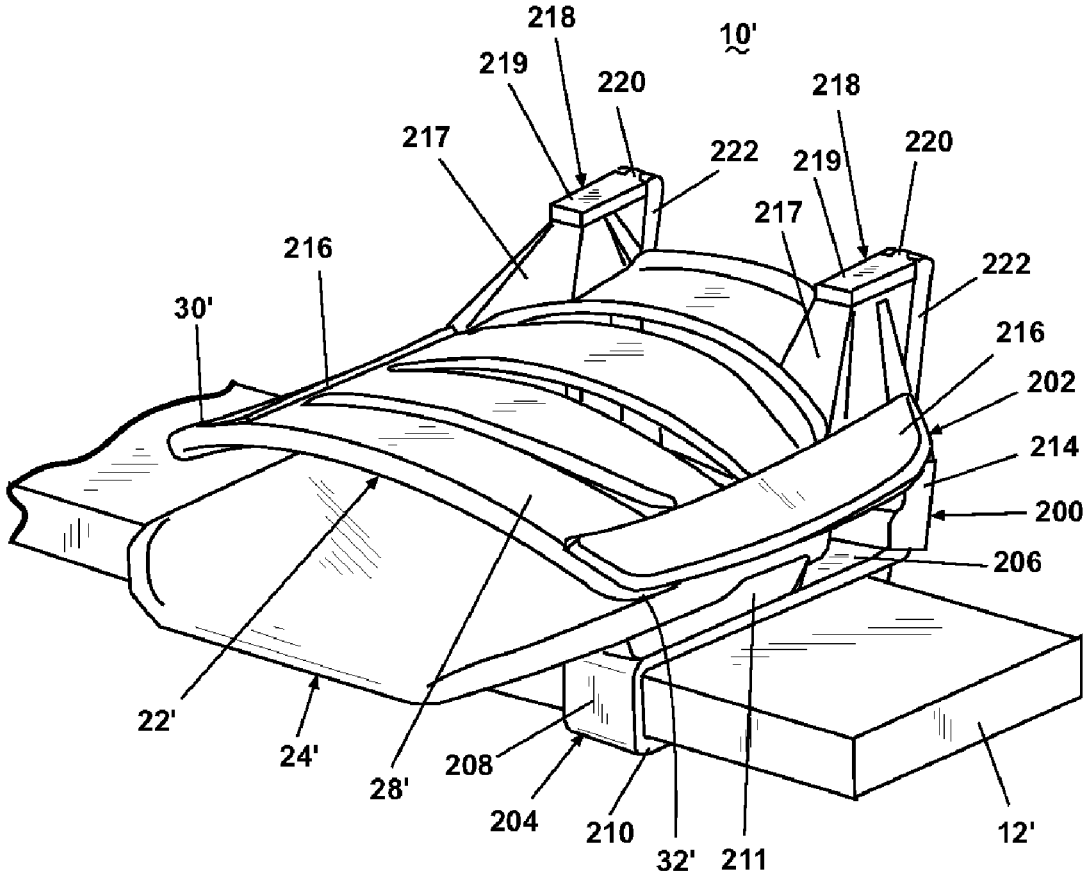
FIG. 16 is front perspective view of a clip-on bleacher mount chair according to the invention, wherein the clip-on bleacher mount chair is in a folded condition.
Figure 17:
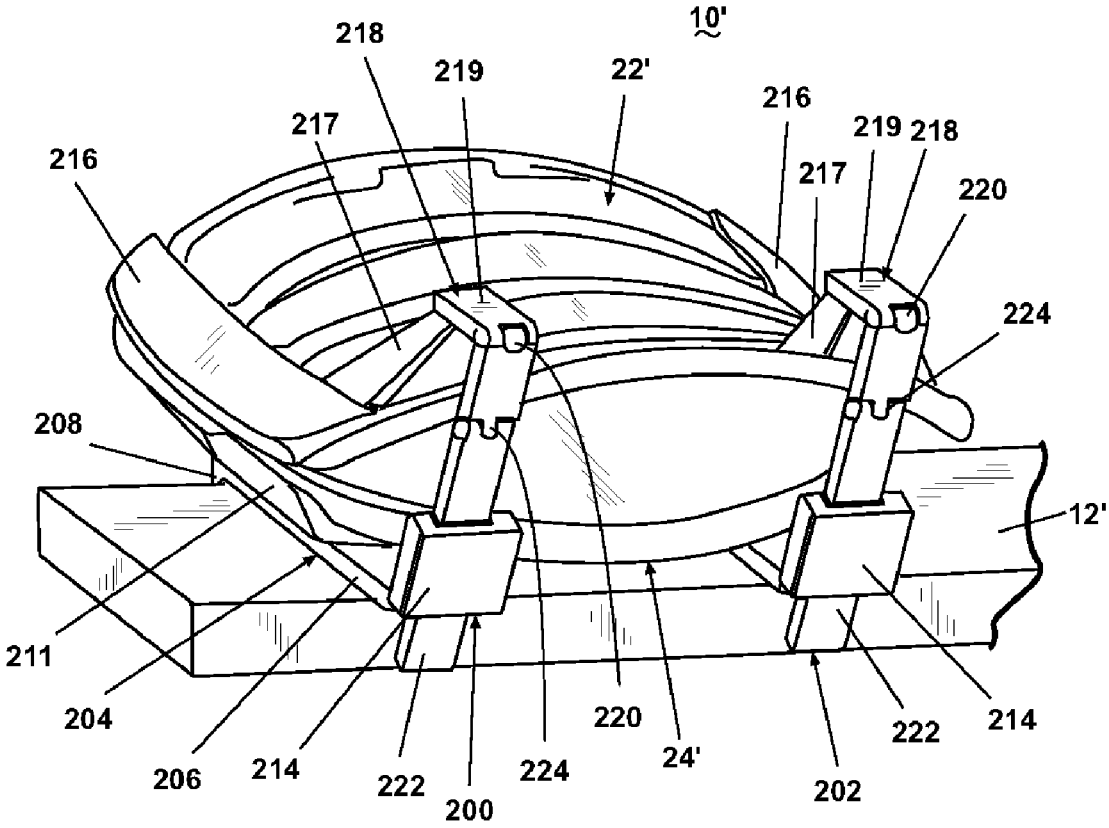
FIG. 17 is a rear perspective view of the clip-on bleacher mount chair from FIG. 16.
Figure 18:
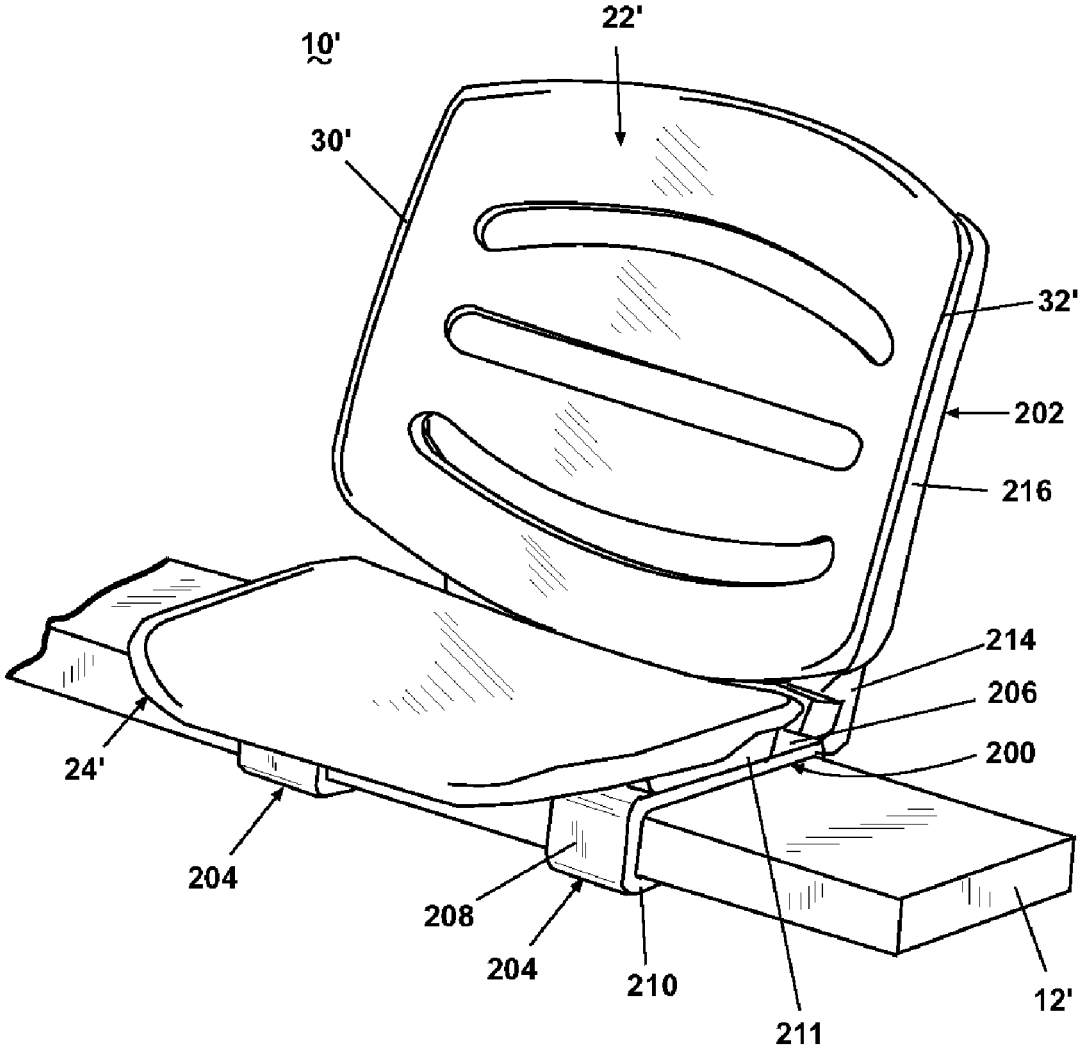
FIG. 18 is a front perspective view of the clip-on bleacher mount chair from FIG. 16 in an unfolded condition.
Figure 19:
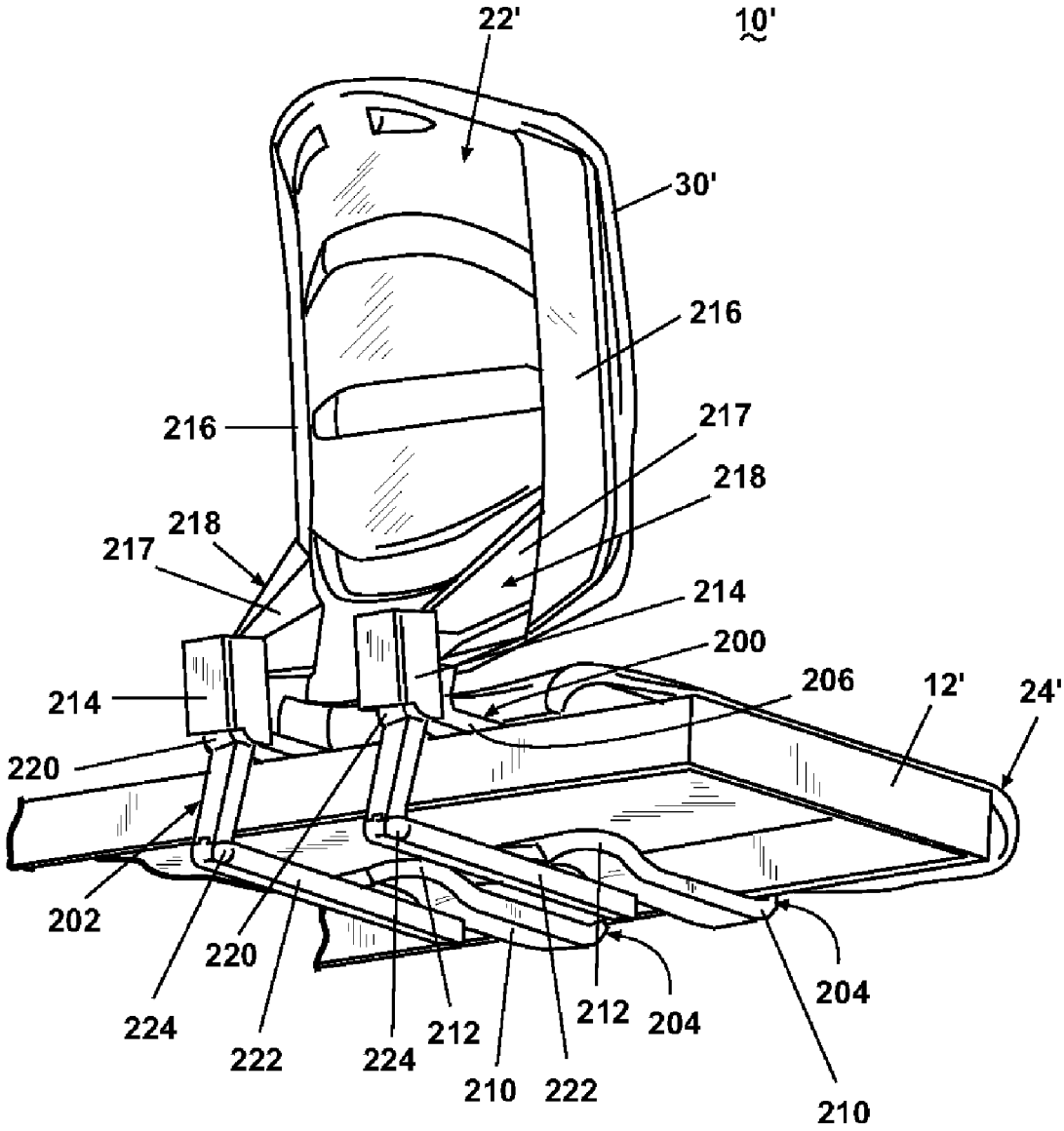
FIG. 19 is a rear perspective view of the clip-on bleacher mount chair from FIG. 18.

A second embodiment of the invention, a clip-on bleacher mount chair 10', is presented in FIGS. 16-22, where like objects are identified with the same reference numerals bearing a prime (') symbol. The clip-on bleacher mount chair 10' can be removably mounted to a bleacher 12' and, therefore, utilized on a transient basis. A person can possess their own clip-on bleacher mount chair 10' and bring it to a venue when desired, and a venue can have an inventory of clip-on bleacher mount chairs 10' for distribution to audience members, perhaps for a rental fee. The clip-on bleacher mount chair 10' is movable between a folded condition, as illustrated in FIGS. 16 and 17, and an unfolded condition, as shown in FIGS. 18 and 19.

The clip-on bleacher mount chair 10' comprises a seat back 22' and a seat 24' that are substantially identical to those in the first embodiment. However, in this embodiment, the seat back 22' is movable between a lowered, storage position when the clip-on bleacher mount chair 10' is in the folded condition and a raised, use position when the clip-on bleacher mount chair 10' is in the unfolded condition. The clip-on bleacher mount chair 10' further comprises a clip-on bleacher base 200 that slidingly receives a seat back support 202. The seat back 22' and the seat 24' are fixed to the seat back support 202 and the clip-on bleacher base 200, respectively.

The clip-on bleacher base 200 has a lower mounting portion in the form of a pair of mounting brackets 204 that define a laterally opening channel sized to receive the bleacher 12'. In particular, each mounting bracket 204 is a resilient clamp in the form of an arm that includes a first horizontal portion 206 that extends across the top surface of the bleacher 12' from the rear edge to the front edge, a vertical portion 208 that wraps around the front edge of the bleacher 12', and a second horizontal portion 210 that projects under the bleacher 12' towards the rear edge. The first horizontal portion 210 includes a mounting block 211 adapted for connecting the seat 24' to the clip-on bleacher base 200. The second horizontal portion 210, which is best viewed in FIG. 19, comprises a resilient curved clamp portion 212 that is biased towards the first horizontal portion 206. When the clip-on bleacher mount chair 10' is mounted to the bleacher 12', the clamp portions 212 exert an upward force on the bleacher 12' to secure the bleacher 12' between the first and second horizontal portions 206 and 210 to thereby retain the clip-on bleacher base 200 and the seat 24' on the bleacher 12'.

The clip-on bleacher base 200 further comprises an upper mounting portion in the form of a pair of sleeves 214 that slidingly receives the seat back support 202. Each sleeve 214 is integral with the first horizontal portion 206 of its respective mounting bracket 204. When the clip-on bleacher mount chair 10' is mounted to the bleacher 12', the sleeves 214 preferably extend over the rear edge of the bleacher 12', as best viewed in FIGS. 17 and 19.

The seat back support 202, as best viewed in FIG. 17, comprises a pair of spaced, L-shaped support arms 216 disposed along side edges 30' and 32' of the seat back 22'. Preferably, the support arms 216 are contoured to mate with a rear surface 28' of the seat back 22'. Each support arm 216 terminates into a tapered base 218 comprising a web 217 and a block 219 that is connected at a first hinge joint 220 to a rod 222. The rods 222 are sized to be slidingly received in the sleeves 214 and can be pivoted about a second hinge joint 224 from a straight configuration, as best viewed in FIG. 17, to a bent configuration, as best viewed in FIG. 19.

Exemplary descriptions of the assembly and operation of the clip-on bleacher mount chair 10' follow. It will be apparent to one of ordinary skill that the assembly and operation procedures can proceed in any logical order and are not limited to the sequences presented below. The following descriptions are for illustrative purposes only and are not intended to limit the invention in any manner.

To begin assembly, the seat 24' is fixed to the mounting blocks 211 of the clip-on bleacher base 200, and the support arms 216 of the seat back support 202 are mounted to the seat back 22'. The seat back support 202 is oriented such that the rods 222 are in the straight configuration and the seat back support 202 is bent at the first hinge joint 220 so that so that an angle between the rods 222 and the supports arms 216 is an acute or right angle. Next, the rods 222 are slid into the brackets until the seat back 22' abuts the seat 24'. The clip-on bleacher mount chair 10' is thereupon in the folded condition for easy storage and transport.

To operate the second embodiment of the invention, the clip-on bleacher mount chair 10' in the folded condition is attached to the bleacher 12'. The clip-on bleacher base 200 is slid onto the front edge of the bleacher 12' until the bleacher 12' is received within the mounting brackets 204 and the sleeves 214 extend beyond the rear edge of the bleacher 12', as shown in FIGS. 16 and 17. The clamp portions 212 exert an upward force on the bleacher 12' to securely retain the clip-on bleacher base 200 on the bleacher 12'. The vertical portions 208 and the rods 222 abut the front and rear edges of the bleacher 12', respectively, to further prevent movement f the clip-on bleacher base 200. The clip-on bleacher mount chair 10' is thence mounted to the bleacher 12' in the folded condition.

Figure 20:
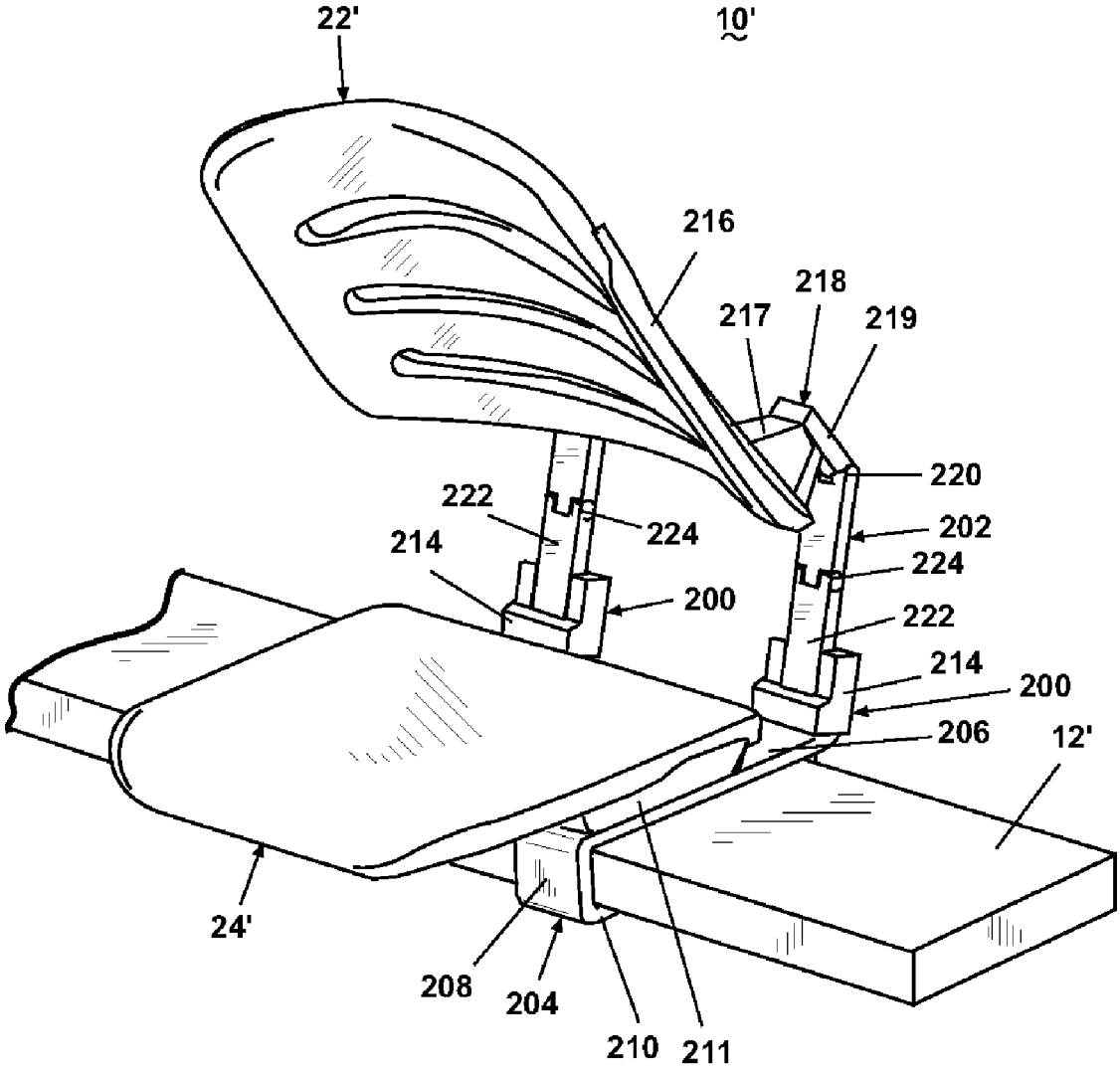
FIGS. 20-22 are perspective views of the clip-on bleacher mount chair from FIG. 16 as it progressively moves from the folded condition shown in FIGS. 16 and 17 to the unfolded condition shown in FIGS. 18 and 19.
Figure 21:
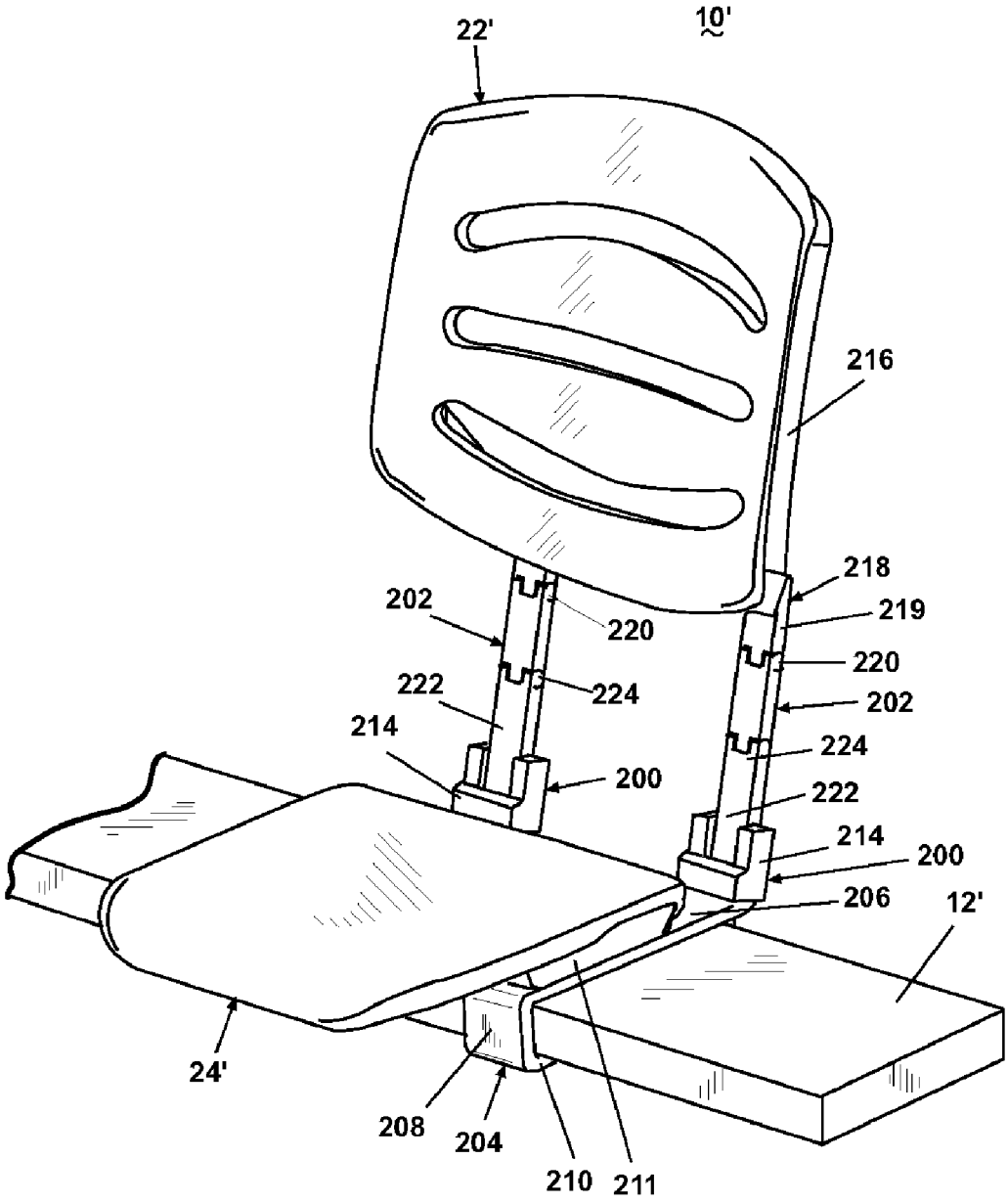
Figure 22:
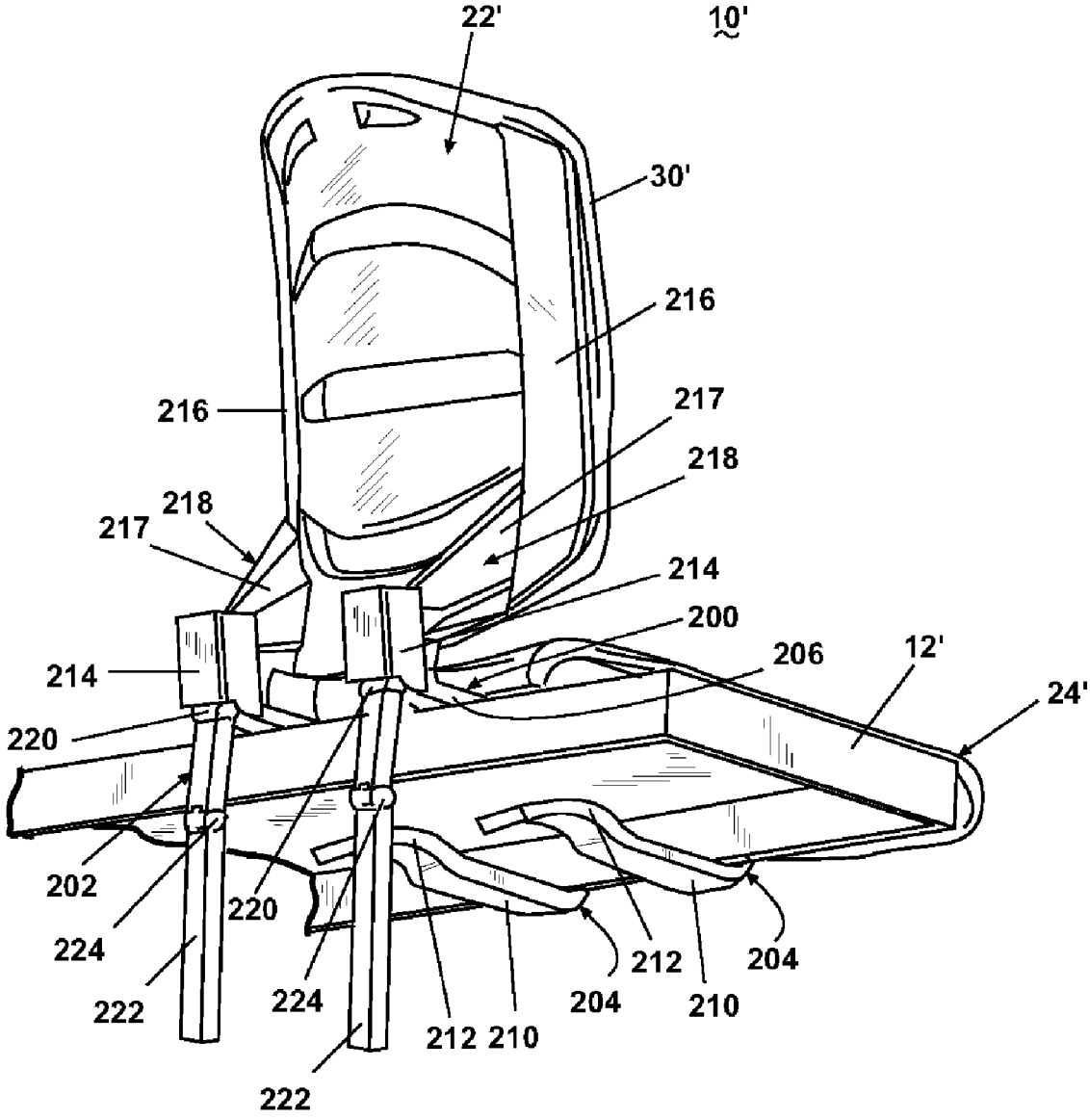

To move the clip-on bleacher mount chair 10' from the folded condition (FIGS. 16 and 17) to the unfolded condition (FIGS. 18 and 19) so that a person can utilize the seat 24', the seat back 22' is pivoted about the first hinge joint 220, as illustrated in FIG. 20, until it is substantially perpendicular to the seat 24', as shown in FIG. 21. Next, the seat back 22' is pushed vertically towards the seat 24', such that the rods 222 slide relative to the sleeves 214, until the sleeves 214 receive the bases 218, in particular the blocks 219, and the seat back 24' nearly abuts the seat 22', as shown in FIG. 22. The bases 218 and the sleeves 214 securely couple to form a robust and structurally sound weight-bearing joint. Finally, the rods 222 are pivoted about the second hinge joint 224 to the bent configuration, as shown in FIG. 19. The above process can be reversed to return the clip-on bleacher mount chair 10' to the folded condition.

Similar to the first embodiment, the clip-on bleacher mount chair 10' is preferably constructed of a "no-break," fade-resistant plastic. Further, the bleacher mount chair 10' is light enough to carry yet strong enough to support a person of considerable weight. Additionally, the clip-on bleacher mount chair 10', whether in the folded or unfolded condition, extends only slightly beyond the envelope of the bleacher 12' and, therefore, does not obstruct traffic through the aisle.

Figure 23:
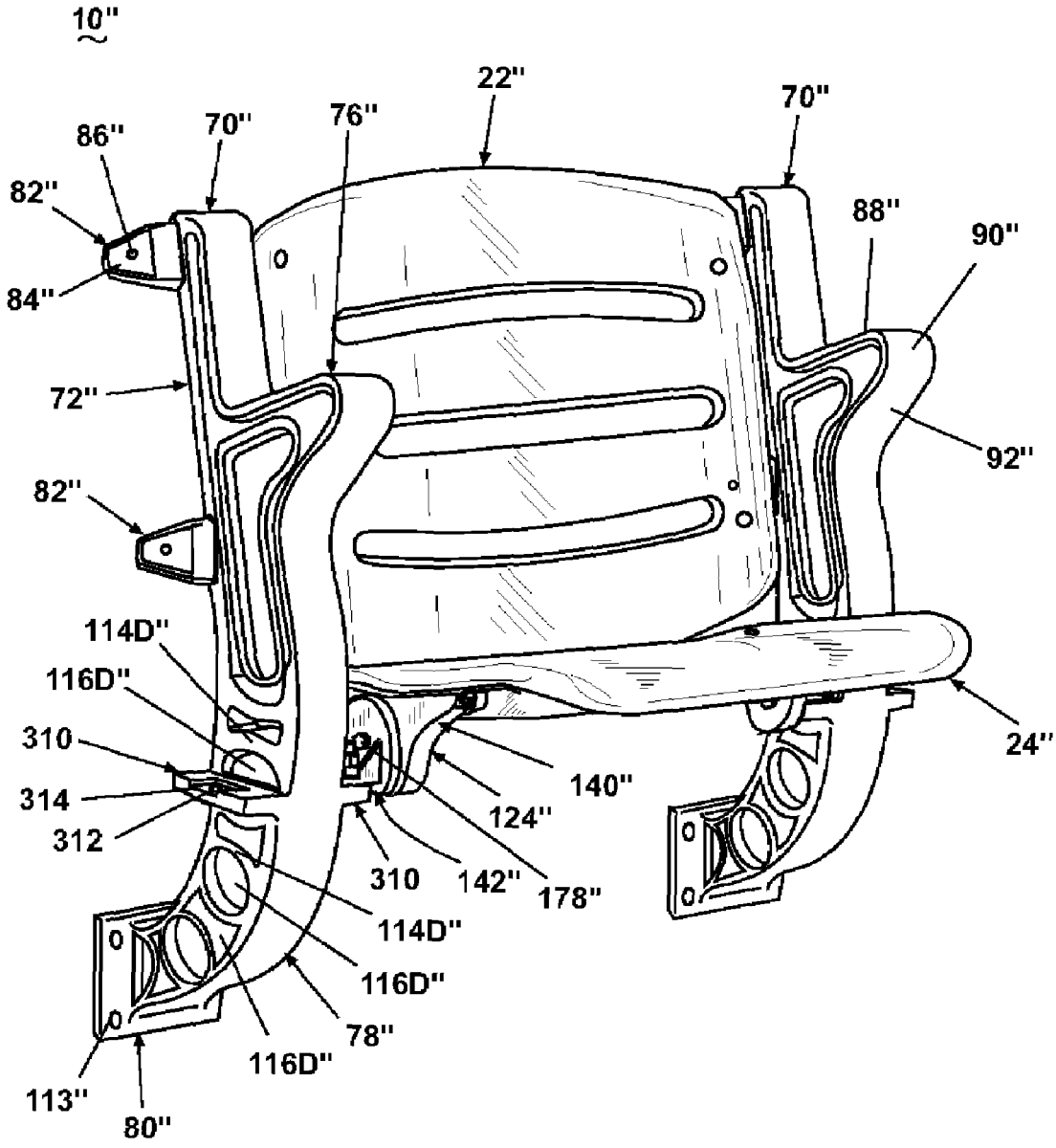
FIG. 23 is a front perspective view of a riser mount chair according to the invention.
Figure 24:
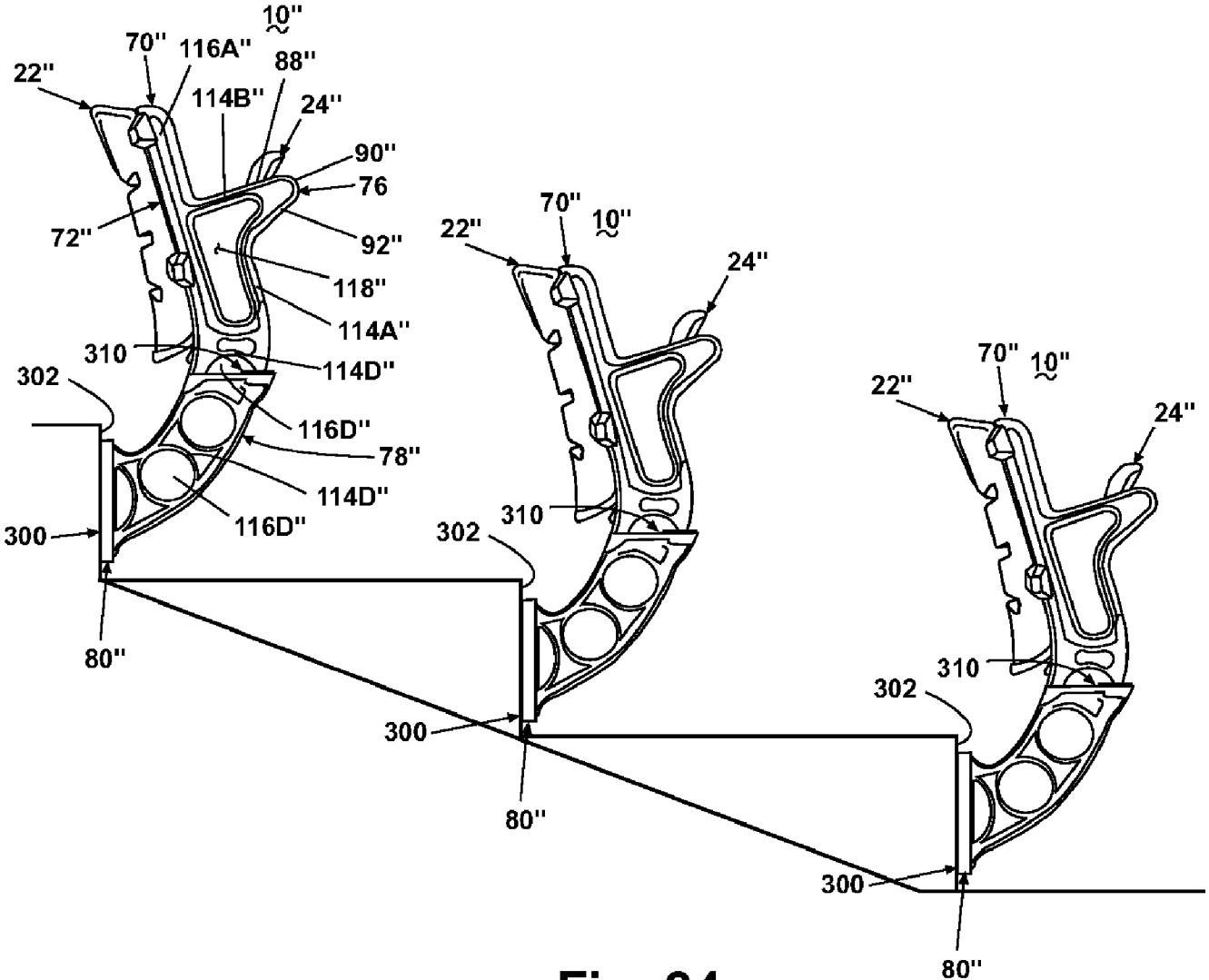
FIG. 24 is a side view of several riser mount chairs from FIG. 23 mounted to riser portions of a step structure.

A third embodiment of the invention, a riser mount chair 10", is presented in FIGS. 23 and 24, where like objects are identified with the same reference numerals bearing a double prime symbol (''). The riser mount chair 10'' can mount to a riser 302 on a step structure 300 and is similar to the bleacher mount chair 10, except that riser bases 70'' replace the bleacher bases 70, and the pivot assembly 120'' comprises only the torsion spring hinge assemblies 124'' (i.e., the riser mount chair 10'' does not include the carriage 122 or the extension springs 190). Because the riser mount chair 10'' mounts to the riser 302, certain cleaning functions, such as sweeping the step structure 300, can be efficiently and quickly executed.

The riser base 70'' comprises an upper mounting portion 72'', an arm rest 76'', and a lower mounting portion 78'' that terminates in a mounting bracket 80'' having mounting holes 113''. The upper mounting portion 72'' and the arm rest 76'' are substantially identical to the corresponding parts in the bleacher base 70. The lower mounting portion 78'' extends down from the arm rest 76'' and curves rearwardly or reversely such that the mounting bracket 80'' achieves a generally vertical orientation. Along the length of the lower mounting portion 78'' are several circular and semi-circular strengthening ribs 114D'' separated by depressions 116D''. Mounting flanges 310 extend laterally from the lower mounting portion 78'' to facilitate mounting the torsion spring hinge assemblies 124'' thereto. Each mounting flange 310 comprises an aperture 312 through a recessed area 314 shaped to receive the torsion spring hinge assembly mounting flange 164''. Similar to the bleacher bases 70, the riser bases 70'' are single-piece components produced using an injection molding process and composed of a "no-break," fade-resistant plastic.

In the current embodiment, rotation of the seat 24'' between the up and down positions does not have to account for the presence of the bleacher 12; consequently, a single pivot axis, the second pivot axis PA2'', is sufficient. The seat 24'' and the seat back 22'' are positioned such that the latter does not obstruct the movement of the former. Additionally, the seat 24'' fits within the depth of the riser base 70'' when in the up position and is situated at a suitable seating height relative to the step structure when in the down position.

While the riser mount chair 10'' is shown as comprising only the single pivot axis PA2'', this embodiment can also incorporate a dual-pivot structure, as in the bleacher mount chair 10, if desired. In place of the mounting flanges 310, the riser base 70'' can easily be adapted to mount a carriage and house an extension spring.

Assembly of the riser mount chair 10'' is identical to the assembly of the bleacher mount chair 10, with the exception of the attachment of the pivot assembly 120''. In short, the torsion spring hinge assembly 124'' is directly mounted to the riser base 70'' with screws 198A'' through the mounting apertures 168'' and 312. Once the seat 24'' is fixed to the torsion spring hinge assemblies 124'' and the seat back 22'' is secured to the riser bases 70'', the riser mount chair 10'', or a linear assembly of riser mount chairs 10'', can be mounted to the riser portion 302 of a step structure 300 with screws (not shown).

To move the riser mount chair 10'' from the up position to the down position, downward force is applied to the seat 24'' to thereby rotate the seat 24'' about the PA2'' and against the bias of the torsion spring hinge assembly 124''. Upon release of the downward force, the torsion spring hinge assembly 124'' biases the seat 24'' back to the up position.

Figure 25:
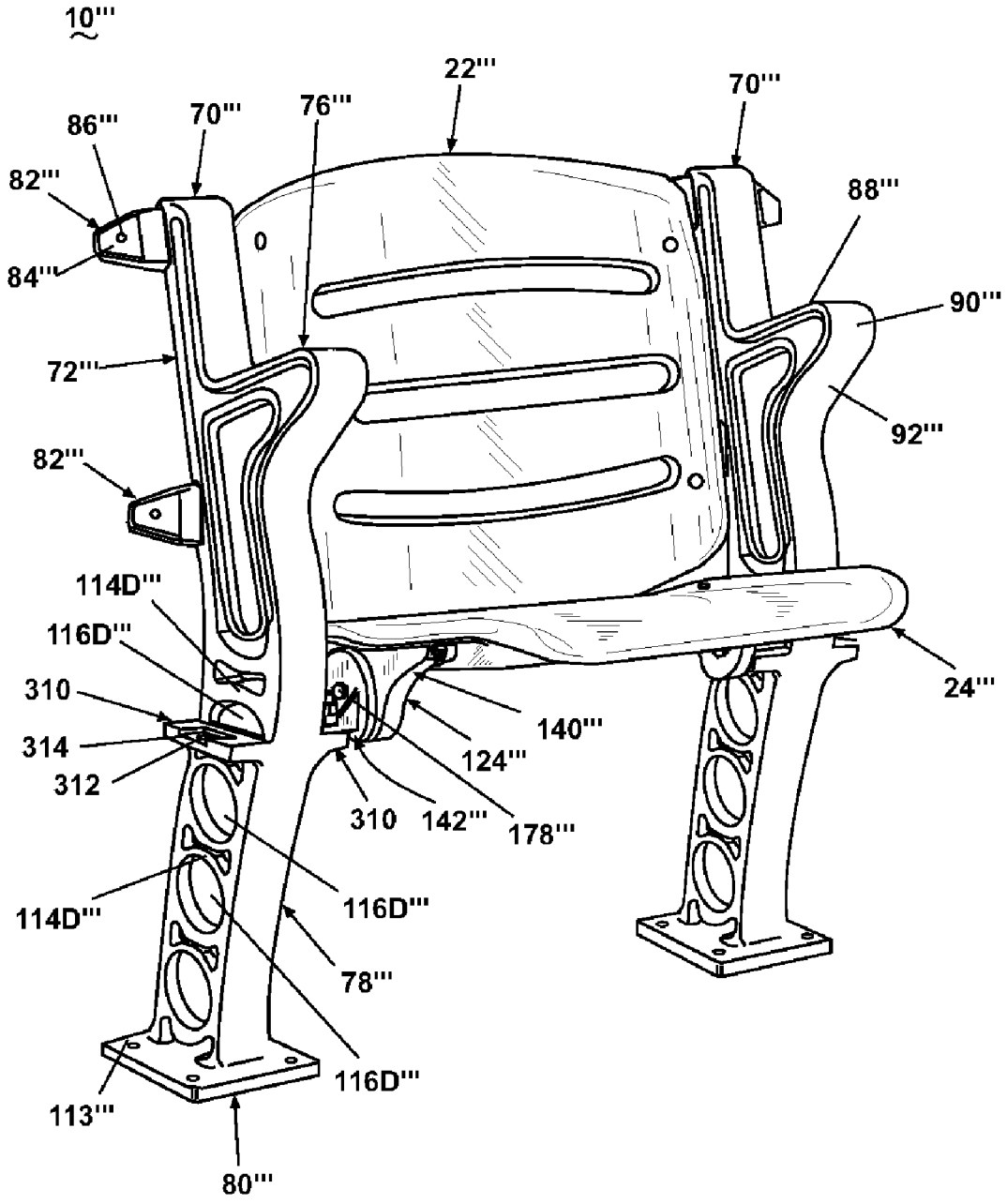
FIG. 25 is a front perspective view of a floor mount chair according to the invention.
Figure 26:
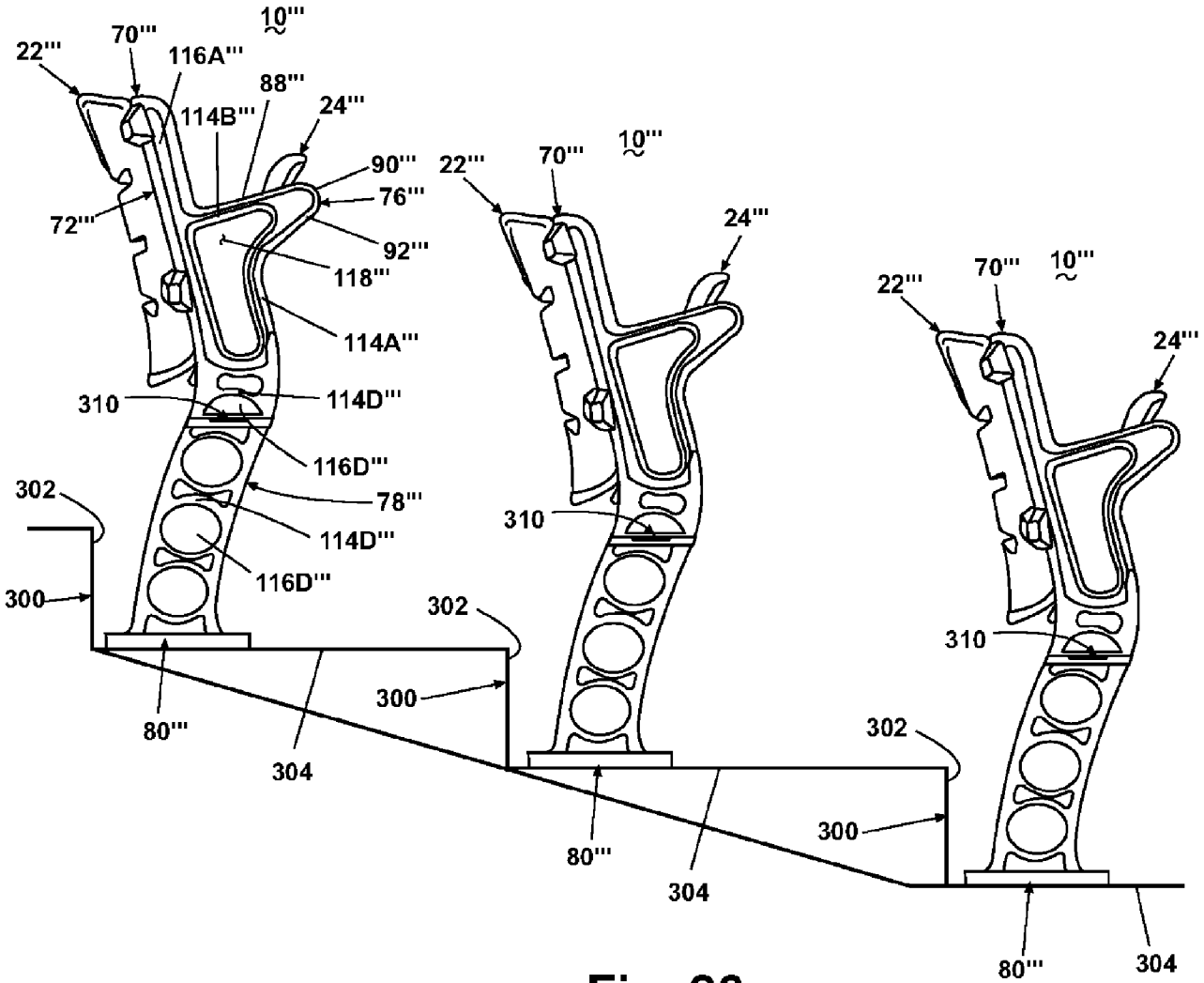
FIG. 26 is a side view of several floor mount chairs from FIG. 25 mounted to floor portions of a step structure.

A fourth embodiment of the invention, a floor mount chair 10''', is presented in FIGS. 25 and 26, where like objects are identified with the same reference numerals bearing a triple prime symbol ('''). The riser mount chair 10''', which can mount to a floor 304 on a step structure 300, is identical to the riser mount chair 10'', except that floor bases 70''' replace the riser bases 70''.

The floor base 70''' comprises an upper mounting portion 72''', an arm rest 76''', and a lower mounting portion 78''' that terminates in a mounting bracket 80''' having mounting holes 113'''. The upper mounting portion 72''', the arm rest 76''', and the lower mounting portion 78''' are substantially identical to the corresponding parts in the riser base 70''; however, the lower mounting portion 78''' extends down from the arm rest 76''' such that it is disposed at a slight angle relative to a vertical axis and the mounting bracket 80' is in a generally horizontal orientation.

The floor mount chair 10''' is assembled in the same manner as the riser mount chair 70''. To secure the floor mount chair 10''', or a linear assembly of floor mount chairs 10''', to the step structure 300, the floor mount chair 10''' is set on the floor 304 in the desired location and mounted thereto with screws (not shown) that pass through the mounting bracket holes 113''' and into the floor 304.

In the embodiments described herein, screws, bolts, and other fasteners are used to secure various components of the chairs to each other or to mount the chair to a bleacher or a step structure. However, it is within the scope of the invention to utilize other fastening and mounting means, including, but not limited to, adhesives, welding or other chemical bonding methods, and other mechanical fasteners.

The bleacher mount, clip-on bleacher mount, riser mount, and floor mount chairs according to the invention provide versatile and robust seating for new venues and for retrofitting existing venues. A durable base composed of a "no-break," fade-resistant plastic designed to withstand potentially harsh environmental conditions, including extreme temperatures and harmful sunlight, supports each chair. The bleacher, riser, and floor bases comprise strategically positioned ribs and depressions for imparting exceptional strength and rigidity to the chairs. Because each base is an injection-molded single piece, the time and cost of production and assembly are minimized, and the probability of defects is reduced.

The bleacher mount chair is ideal for retrofitting venues with existing bleachers. The dual-pivot structure enables the chair to compactly fit within the bleacher envelope when in the up position and to be located at a suitable seating height when in the down position. The bleacher mount chair can fit onto narrowly spaced bleachers without blocking the aisles when in the up position. Furthermore, the bleacher mount chair is adapted to be easily, quickly, and securely mounted to bleachers.

In addition to the bleacher mount chair, the clip-on bleacher mount chair can be utilized for retrofitting venues with existing bleachers. Because the clip-on bleacher mount chair is removable, it can be used on a transient basis if desired. When mounted on the bleacher, the clip-on bleacher mount chair, whether in the folded or unfolded conditions, extends only slightly beyond the bleacher envelope and does not obstruct traffic through the aisles.

The simple, yet structurally sound, riser mount and floor mount chairs provide durable seating for venues. Because the riser mount chair is fixed to the riser, the floor remains free of obstructions for facile sweeping and cleaning. On the other hand, because the floor mount chair is secured to the floor, it can bear a significant amount of weight, which is a great advantage considering that the population of overweight individuals is increasing.

While the invention has been specifically described in connection with certain specific embodiments thereof, it is to be understood that this is by way of illustration and not of limitation, and the scope of the appended claims should be construed as broadly as the prior art will permit.

What is claimed is:

1. A chair for use in a mass seating venue comprising:

at least one base having an upper mounting portion and a lower mounting portion;

a seat back mounted to the upper mounting portion of the base;

a seat support pivotally mounted to the base for movement between a first lowered position and a first raised position about a first pivot axis and the seat support is biased into the first raised position by a first spring acting between the seat support and the base;

a seat pivotally mounted to the seat support for movement between a second lowered position and a second raised position about a second pivot axis different than the first pivot axis, and biased into the second raised position by a second spring acting between the seat and the seat support; and a hinge assembly comprising a first mounting bracket mounted to the seat and a second mounting bracket mounted to the seat support, the first mounting bracket being supported for pivotal movement with respect to the second mounting bracket by a bearing;

wherein the seat support comprises an arm connecting the first pivot axis with the second pivot axis and the second pivot axis moves with respect to the first pivot axis when the seat support is moved relative to the base; and wherein the second spring comprises a torsion spring acting between the first and second mounting brackets around the bearing.

2. The chair of claim 1 wherein one of the base and the seat support comprises an arcuate track and the other of the base and the seat support comprises a follower pin in register with the track, whereby the track provides a limited range of movement for the seat support relative to the base by virtue of the location of the follower pin within the track.

3. The chair of claim 1 and further comprising means for both pivoting and laterally shifting the seat relative to the base as the seat moves between the raised storage and lowered use positions.

4. A chair for use in a mass seating venue comprising:

at least one base having an upper mounting portion and a lower mounting portion;

a seat back mounted to the upper mounting portion of the base;

a seat support pivotally mounted to the base for movement between a first lowered position and a first raised position about a first pivot axis; and a seat pivotally mounted to the seat support for movement between a second lowered position and a second raised position about a second pivot axis different than the first pivot axis;

wherein the seat is biased into the second raised position by a spring acting between the seat and the seat support.

5. The chair of claim 4 wherein the second pivot axis moves with respect to the first pivot axis when the seat support is moved relative to the base.

6. The chair of claim 5 wherein the seat support comprises an arm connecting the first pivot axis with the second pivot axis.

7. The chair of claim 4 wherein the second pivot axis is offset upwardly with respect to the first pivot axis.

8. The chair of claim 4 wherein the second pivot axis is offset diagonally with respect to the first pivot axis.

9. The chair of claim 4 wherein the lower mounting portion of the base comprises a bracket sized to receive a bleacher.

10. The chair of claim 4 wherein the seat support comprises an arm connecting the first pivot axis with the second pivot axis.

11. A chair for use in a mass seating venue comprising:

at least one base having an upper mounting portion and a lower mounting portion;

a seat back mounted to the upper mounting portion of the base;

a seat support pivotally mounted to the base for movement between a first lowered position and a first raised position about a first pivot axis;

a seat pivotally mounted to the seat support for movement between a second lowered position and a second raised position about a second pivot axis different than the first pivot axis; and a hinge assembly comprising a first mounting bracket mounted to the seat and supported by a bearing for pivotal movement with respect to a second mounting bracket mounted to the seat support, and a torsion spring acting between the first and second mounting brackets around the bearing.

12. A chair for use in a mass seating venue comprising:

at least one base having an upper mounting portion and a lower mounting portion;

a seat back mounted to the upper mounting portion of the base;

a seat support pivotally mounted to the base for movement between a first lowered position and a first raised position about a first pivot axis; and a seat pivotally mounted to the seat support for movement between a second lowered position and a second raised position about a second pivot axis different than the first pivot axis;

wherein one of the base and the seat support comprises an arcuate track and the other of the base and the seat support comprises a follower pin in register with the track, whereby the track provides a limited range of movement for the seat support relative to the base by virtue of the location of the follower pin within the track.

13. A chair for use in a mass seating venue comprising:

at least one base having an upper mounting portion and a lower mounting portion;

a seat back mounted to the upper mounting portion of the base;

a seat moveable relative to the base for movement between a raised storage position and a lowered use position, wherein in the lowered use position the seat is positioned to be sat upon by a user;

a seat support for mounting the seat to the base;

a hinge assembly comprising a first mounting bracket mounted to the seat and supported by a bearing for pivotal movement with respect to a second mounting bracket mounted to the seat support, for both pivoting and laterally shifting the seat relative to the base as the seat moves between the raised storage and lowered use positions; and a torsion spring acting between the first and second mounting brackets around the bearing.

14. The chair of claim 13 wherein one of the base and the seat support comprises an arcuate track and the other of the base and the seat support comprises a follower pin in register with the track, whereby the track provides a limited range of movement for the seat support relative to the base by virtue of the location of the follower pin within the track.

15. The chair of claim 13 wherein the lower mounting portion of the base comprises a bracket sized to receive a bleacher.

16. The chair of claim 15 wherein the bracket of the base opens downwardly to receive the bleacher.

17. The chair of claim 16 wherein the bracket further comprises at least one mounting aperture so that the lower mounting portion of the base can be mounted to the bleacher by a fastener passing through the at least one mounting aperture in the bracket.

18. The chair of claim 13 wherein at least one of the seat back and the seat is pivotally mounted to the base.

19. The chair of claim 18 wherein the seat is pivotally mounted to the base for movement between a raised storage position and a lowered use position, wherein in the lowered use position the seat is positioned to be sat upon by a user.

* * * * *